US011006796B2

(12) United States Patent
Kwon et al.

(10) Patent No.: US 11,006,796 B2
(45) Date of Patent: May 18, 2021

(54) SUCTION NOZZLE AND VACUUM CLEANER AND ROBOT CLEANER HAVING THE SAME

(71) Applicant: Samsung Electronics Co., Ltd., Suwon-si (KR)

(72) Inventors: Ki-hwan Kwon, Hwaseong-si (KR); Dong-woo Ha, Hwaseong-si (KR); Seok-man Hong, Suwon-si (KR); Dong-wook Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 101 days.

(21) Appl. No.: 15/673,647

(22) Filed: Aug. 10, 2017

(65) Prior Publication Data

US 2018/0084961 A1 Mar. 29, 2018

(30) Foreign Application Priority Data

Sep. 23, 2016 (KR) ..... 10-2016-0122429
Dec. 14, 2016 (KR) ..... 10-2016-0170620

(51) Int. Cl.
*A47L 9/06* (2006.01)
*A47L 5/28* (2006.01)
(Continued)

(52) U.S. Cl.
CPC ..... *A47L 9/0606* (2013.01); *A47L 5/28* (2013.01); *A47L 9/0411* (2013.01);
(Continued)

(58) Field of Classification Search
CPC .... A47L 9/0483; A47L 9/0488; A47L 9/0411; A47L 9/0455; A47L 11/12; A47L 11/294
(Continued)

(56) References Cited

U.S. PATENT DOCUMENTS 1,336,760 A * 4/1920 Stewart ..... A47L 5/30 15/368
1,925,350 A * 9/1933 Tucker ..... A47L 9/0411 310/29
(Continued)

FOREIGN PATENT DOCUMENTS

CN 2072823 U 3/1991
CN 1575733 2/2005
(Continued)

OTHER PUBLICATIONS

International Search Report and Written Opinion of the International Searching Authority dated Jan. 10, 2018 in International Patent Application No. PCT/KR2017/009932.
(Continued)

*Primary Examiner* — Brian D Keller
*Assistant Examiner* — Thomas Raymond Rodgers
(74) *Attorney, Agent, or Firm* — Staas & Halsey LLP

(57) ABSTRACT

A suction nozzle, and a vacuum cleaner, and a robot cleaner includes a housing having a suction port formed on a bottom surface thereof and a suction flow path formed on an inside thereof to communicate with the suction port, and a vibration cleaning unit arranged on the suction flow path to pass therethrough air including pollutants that flows in through the suction port, wherein the vibration cleaning unit includes a vibration source, a vibration transfer frame configured to accommodate the vibration source, and a vibration bar configured to receive vibration transferred from the vibration transfer frame to resonate.

20 Claims, 34 Drawing Sheets

(51) Int. Cl.
*A47L 9/04* (2006.01)
*A47L 9/28* (2006.01)

(52) U.S. Cl.
CPC ..... *A47L 9/0466* (2013.01); *A47L 9/066* (2013.01); *A47L 9/2826* (2013.01); *A47L 9/2852* (2013.01); *A47L 2201/04* (2013.01)

(58) Field of Classification Search
USPC ..... 15/379
See application file for complete search history.

(56) References Cited

U.S. PATENT DOCUMENTS 6,148,475 A * 11/2000 Stross ..... A47L 5/30 15/380
6,925,679 B2 * 8/2005 Wallach ..... A47L 5/36 15/319
7,234,198 B2 6/2007 Bosses
7,363,682 B2 4/2008 Lim et al.
8,713,753 B2 5/2014 Lim
2004/0123417 A1 7/2004 Worwag
2005/0015922 A1 1/2005 Lim et al.
2011/0010890 A1 1/2011 Dimbylow et al.
2011/0088207 A1 * 4/2011 Lim ..... A47L 9/0411 15/363
2014/0250626 A1 * 9/2014 Bosses ..... A47L 9/0483 15/379
2015/0135476 A1 5/2015 Eaglestone
2015/0320279 A1 * 11/2015 Ebrahimi Afrouzi ..... A47L 9/0477 134/6
2015/0335220 A1 * 11/2015 Kim ..... A47L 11/282 15/49.1

FOREIGN PATENT DOCUMENTS

JP 4-200422 7/1992
JP 7-313411 12/1995
JP 2002-78651 3/2002
JP 2005-131188 5/2005
JP 2015-516253 6/2015
KR 10-2005-0108551 11/2005
KR 10-1004544 1/2011
KR 20-0477155 5/2015
WO 2013/171468 11/2013
WO WO 2016/021419 A1 2/2016

OTHER PUBLICATIONS

Extended European Search Report dated Jul. 11, 2019 in European Patent Application No. 17853336.0.
Chinese Office Action dated Sep. 4, 2019 in Chinese Patent Application No. 201710890628.7.
Chinese Office Action dated Jun. 29, 2020 in Chinese Patent Application No. 201710890628.7.
Chinese Office Action dated Mar. 2, 2021, in corresponding Chinese Patent Application No. 201710890628.7.

* cited by examiner

SUCTION NOZZLE AND VACUUM CLEANER AND ROBOT CLEANER HAVING THE SAME

CROSS-REFERENCE TO RELATED APPLICATIONS

This application claims priority from Korean Patent Application No. 10-2016-0122429 filed on Sep. 23, 2016 and Korean Patent Application No. 10-2016-0170620 filed on Dec. 14, 2016, in the Korean Intellectual Property Office, the disclosures of which are incorporated herein by reference in their entirety.

BACKGROUND

1. Field

The following description relates to a suction nozzle, a vacuum cleaner and a robot cleaner having the same, and more particularly, to a suction nozzle having a vibration cleaning unit for shaking pollutants off a surface to be cleaned, and a vacuum cleaner and a robot cleaner having the same.

2. Description of the Related Art

In general, a vacuum cleaner is a device which sucks and removes pollutants, such as dust, from a surface to be cleaned, such as a hard floor or a carpet, using a suction force generated by a suction source.

Such a vacuum cleaner is provided with a suction nozzle configured to come in contact with a surface to be cleaned and to suck pollutants existing on the surface to be cleaned during movement of the cleaner. The suction nozzle includes a housing that corresponds to a main body, a suction port formed on one surface of the housing to suck the pollutants existing on the surface to be cleaned, and a brush arranged near the suction port to brush away the pollutants on the surface to be cleaned. The brush is fixed to the nozzle or is rotatably installed on the nozzle. In addition, the suction nozzle may be provided with a vibration tool that strikes the surface to be cleaned.

In the case of cleaning a carpet using a suction nozzle having a vibration tool, the vibration tool strikes the carpet, and pollutants that are stuck in the carpet are guided to rise up to the surface of the carpet due to vibration generated by the vibration tool. In this case, however, the vibration tool operates to press the dust stuck in the carpet, and thus cleaning performance is deteriorated. Further, if the surface to be cleaned is a hard floor, noise may occur due to striking sound that is generated when the vibration tool strikes the floor.

Further, in the case of cleaning using a suction nozzle having a rotary brush, it frequently occurs that hair is wound on the rotary brush. If the hair is wound on the brush as described above, it gets tangled even on structures arranged around the suction port to cause the suction port to be clogged, and thus the suction efficiency is deteriorated. Because of this, it is necessary for a user to remove the tangled hair from the brush, and this kind of work may cause trouble or inconvenience to the user. Further, in order to rotate the brush, it is required to drive a motor at several thousands of rpm through supply of high power of several tens of watts to cause large power consumption.

The suction port is formed on the housing of the suction nozzle with an area that is smaller than the area of the housing of the suction nozzle in order to form a vacuum between the surface to be cleaned and the housing of the suction nozzle so as to efficiently suck the dust from the surface to be cleaned.

On the other hand, if the surface to be cleaned is formed at a point where walls join together, the suction port is unable to reach the surface to be cleaned because the housing of the suction nozzle is larger than the suction port. In this case, it is not possible to suck the dust existing on the cornered surface to be cleaned to deteriorate the cleaning efficiency. Accordingly, the user should clean the cornered surface to be cleaned using a separate broom or the like.

In the case of applying the vibration cleaning tool in the related art to a robot cleaner, the use time of the robot cleaner is reduced due to excessive power consumption to lower the cleaning efficiency.

Further, even in the robot cleaner, a suction port is formed thereon with a size that is smaller than the size of a main body in order to form a vacuum between a surface to be cleaned and the suction port so as to efficiently suck dust from the surface to be cleaned. In this case, however, in the same manner as the vacuum cleaner as described above, it is not possible to suck the dust existing on the cornered surface to be cleaned to deteriorate the cleaning efficiency.

SUMMARY

Exemplary embodiments of the present disclosure overcome the above disadvantages and other disadvantages not described above, and provide a suction nozzle having a vibration cleaning unit for improving cleaning efficiency of a surface to be cleaned, and a vacuum cleaner and a robot cleaner having the same.

Further, exemplary embodiments of the present disclosure provide a suction nozzle having a vibration cleaning unit having a simple structure to save the manufacturing cost and capable of being driven with low power, and a vacuum cleaner and a robot cleaner having the same.

Further, exemplary embodiments of the present disclosure provide a suction nozzle having a vibration cleaning unit capable of efficiently cleaning a cornered surface to be cleaned, and a vacuum cleaner and a robot cleaner having the same.

According to an aspect of the present disclosure, a suction nozzle includes a housing having a suction port formed on a bottom surface thereof and a suction flow path formed on an inside thereof to communicate with the suction port; and a vibration cleaning unit arranged on the suction flow path to pass therethrough air including pollutants that flows in through the suction port, wherein the vibration cleaning unit includes a vibration source; a vibration transfer frame configured to accommodate the vibration source; and a vibration bar configured to receive vibration transferred from the vibration transfer frame to resonate.

The vibration cleaning unit may vibrate along a proceeding direction of the suction nozzle.

A pollutant inflow space may be formed between the vibration transfer frame and the vibration bar, and the pollutant inflow space may be arranged on the suction flow path.

The vibration transfer frame and the vibration bar may be mutually connected by a connection member.

The vibration source may be fixed to a holder that is coupled to the vibration transfer frame.

The holder may include a plurality of support projections arranged on an inside thereof to support the vibration source.

The vibration transfer frame, the connection member, and the vibration bar may be integrally formed.

The vibration bar may be formed along a length direction of the suction port, and may include a skirt that comes in contact with a surface to be cleaned.

The skirt may include a plurality of projections arranged at intervals along a lower portion of one surface of the skirt.

The vibration bar may further include at least one rubber blade coupled along a lower end thereof.

The suction nozzle according to the aspect of the present disclosure may further include at least one extension blade that is formed to extend from both ends of the rubber blade, wherein at least one extension groove for accommodating the extension blade therein is formed on both sides of the suction port.

The rubber blade may further include a plurality of projections arranged at intervals along a lower portion of one surface of the rubber blade.

The rubber blade may further include an auxiliary blade that projects further than the rubber blade in a downward direction.

The suction nozzle according to the aspect of the present disclosure may further include at least one extension portion formed to extend from both ends of the vibration bar; and at least one extension groove formed on both sides of the suction port, wherein the extension portion is integrally formed with the vibration bar, and is accommodated in the extension groove.

The suction nozzle according to the aspect of the present disclosure may further include a brush coupled to the vibration bar.

The suction nozzle according to the aspect of the present disclosure may further include at least one rubber blade coupled to the vibration bar, wherein the rubber blade is positioned on one side or the other side of the brush.

The suction nozzle according to the aspect of the present disclosure may further include a pair of rubber blades coupled to the vibration bar and arranged in front and rear of the brush.

Any one of the pair of rubber blades may include a plurality of projections arranged at intervals along a lower portion of a front surface of the corresponding rubber blade.

The vibration cleaning unit may include a plurality of elastic members arranged at both ends of the vibration transfer frame.

Each of the plurality of elastic members may have one side coupled to the housing and the other side coupled to the vibration cleaning unit.

A cross-sectional surface of the vibration transfer frame may be in "U" or "H" shape.

The vibration source may be a vibration motor or a vibration actuator.

The suction nozzle according to the aspect of the present disclosure may further include at least one extension portion formed to extend in a body with both ends of the vibration bar; at least one extension groove formed on both sides of the suction port to accommodate the extension portion therein; and at least one extension suction port having one end connected to a side end of the extension groove and the other end that is open toward a side end of the housing.

The suction nozzle according to the aspect of the present disclosure may further include a wing portion additionally extending from the extension portion, wherein a part of the wing portion is accommodated in the extension suction port, and the remainder thereof projects to an outside of the housing of the suction nozzle.

The wing portion may be formed to have a predetermined angle with the vibration bar.

The suction nozzle according to the aspect of the present disclosure may further include at least one extension groove formed on both sides of the suction port; at least one extension suction port having one end connected to a side end of the extension groove and the other end that is open toward a side end of the housing; and at least one wing portion extending from the rubber blade, wherein a part of the wing portion is accommodated in the extension suction port, and the remainder of the wing portion projects to an outside of the housing of the suction nozzle.

The wing portion may be integrally formed with the rubber blade and may come in contact with a surface to be cleaned.

The wing portion may be a brush that comes in contact with the surface to be cleaned.

The extension suction port and the wing portion may be formed to have a predetermined angle with the vibration bar.

The wing portion may be supported by at least one support.

The brush may be supported by at least one support.

The vibration transfer frame and the vibration bar may be made of plastic or stainless steel.

The thickness of both end portions of the vibration bar may be thicker than the thickness of a center portion of the vibration bar.

The suction nozzle according to the aspect of the present disclosure may further include a variable portion formed on at least one end of the suction nozzle to be able to open one end of the suction port; and an elastic member configured to be able to elastically move the variable portion from a second position to a first position.

The suction nozzle according to the aspect of the present disclosure may further include at least one hinge element formed at one end of the suction nozzle, wherein the elastic member is a torsion spring arranged around the hinge element, and the variable portion is rotated between the first and second positions around the hinge element.

The suction nozzle according to the aspect of the present disclosure may further include a sliding element formed between one end of the suction nozzle and the variable portion, wherein the elastic member is a coil spring or a pin spring, and the variable portion is movable between the first and second positions along the sliding element.

According to an aspect of the present disclosure, a vacuum cleaner includes a main body; a housing connected to the main body and having a suction port; and a suction nozzle arranged inside the housing and including a vibration cleaning unit having a lower portion positioned adjacent to the suction port, wherein a vibration source is accommodated in an upper portion of the vibration cleaning unit, and the vibration cleaning unit receives vibration generated and transferred from the vibration source to resonate, and a lower portion of the vibration cleaning unit is transformed by the resonance to clean a surface to be cleaned.

According to an aspect of the present disclosure, a robot cleaner includes a main body having a suction port on a bottom surface thereof; a traveling unit installed on the main body; an obstacle sensing unit installed on a front portion of the main body to sense an obstacle; a vibration cleaning unit arranged inside the main body and positioned adjacent to the suction port; and a controller configured to control the traveling unit in accordance with obstacle information input from the obstacle sensing unit and to control the vibration cleaning unit, wherein a vibration source is accommodated in an upper portion of the vibration cleaning unit, and the vibration cleaning unit receives vibration generated and transferred from the vibration source to resonate, and a lower portion of the vibration cleaning unit is transformed by the resonance to clean a surface to be cleaned.

Additional and/or other aspects and advantages of the disclosure will be set forth in part in the description which follows and, in part, will be obvious from the description, or may be learned by practice of the disclosure.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION

Figure 1:
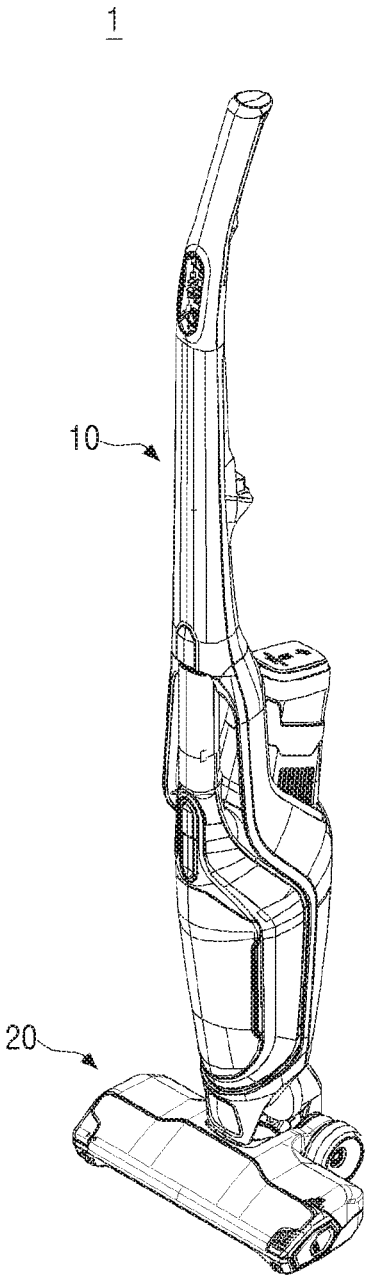
FIG. 1 is a perspective view illustrating a vacuum cleaner having a suction nozzle mounted thereon according to an embodiment of the present disclosure.

The exemplary embodiments of the present disclosure may be diversely modified. Accordingly, specific exemplary embodiments are illustrated in the drawings and are described in detail in the detailed description. However, it is to be understood that the present disclosure is not limited to a specific exemplary embodiment, but includes all modifications, equivalents, and substitutions without departing from the scope and spirit of the present disclosure. Also, well-known functions or constructions are not described in detail because they would obscure the disclosure with unnecessary detail.

The terms "first", "second", etc. may be used to describe diverse components, but the components are not limited by the terms. The terms are only used to distinguish one component from the others.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

Hereinafter, various exemplary embodiments of the present disclosure will be described with reference to the accompanying drawings. However, it should be understood that the present disclosure is not limited to the specific embodiments described hereinafter, but includes various modifications, equivalents, and/or alternatives of the embodiments of the present disclosure. In relation to explanation of the drawings, similar drawing reference numerals may be used for similar constituent elements.

A vibration cleaning unit according to the present disclosure can be applied to various types of vacuum cleaner and robot cleaner.

FIG. 1 is a perspective view illustrating a vacuum cleaner 1 having a suction nozzle 20 connected thereto according to an embodiment of the present disclosure.

It is described that the vacuum cleaner 1 according to an embodiment of the present disclosure is applied to an upright vacuum cleaner. However, the vacuum cleaner 1 according to an embodiment of the present disclosure is not limited thereto, but may be applied to various kinds of vacuum cleaners including a canister vacuum cleaner.

As illustrated in FIG. 1, a suction nozzle 20 is connected to a lower end of a main body 10 of the vacuum cleaner.

Hereinafter, referring to FIGS. 2 to 11, a suction nozzle having a vibration cleaning unit and the vibration cleaning unit according to an embodiment of the present disclosure will be described in detail.

Figure 2:
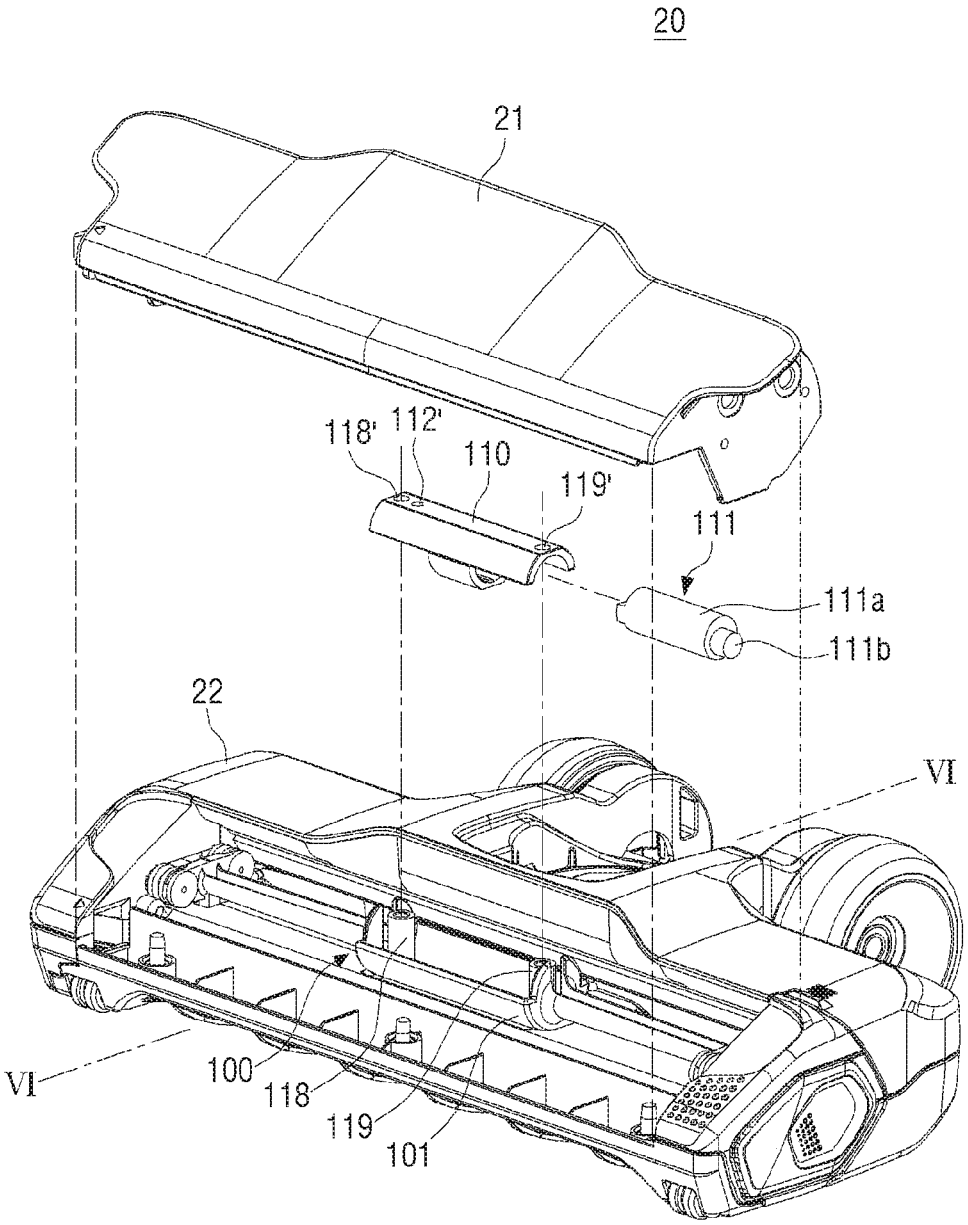
FIG. 2 is an exploded perspective view illustrating the suction nozzle of FIG. 1 and the internal configuration of the suction nozzle.
Figure 4:
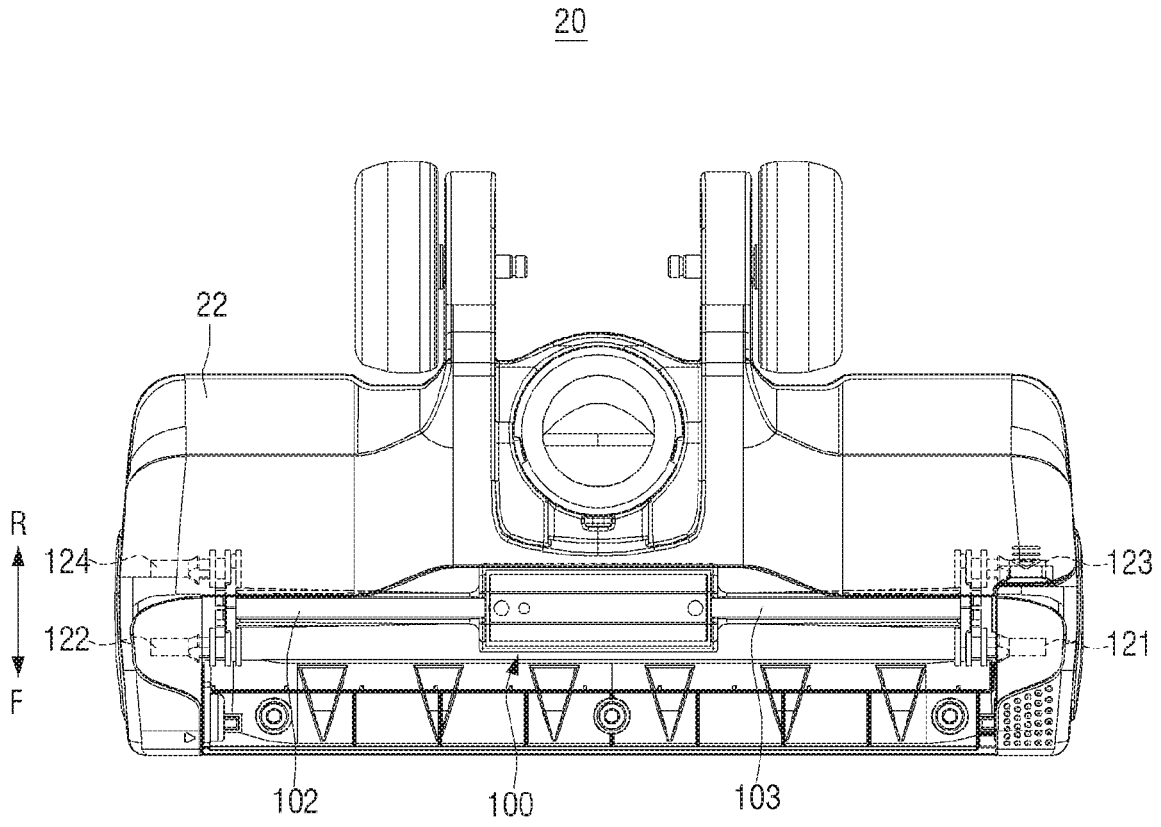
FIG. 4 is a plan view illustrating a suction nozzle from which a housing cover is separated.

FIG. 2 is an exploded perspective view illustrating the suction nozzle of FIG. 1 and the internal configuration of the suction nozzle, and FIG. 4 is a plan view illustrating a suction nozzle from which a housing cover is separated. Further, FIG. 6 is a cross-sectional view of a suction nozzle taken along line VI-VI of FIG. 2.

Figure 6:
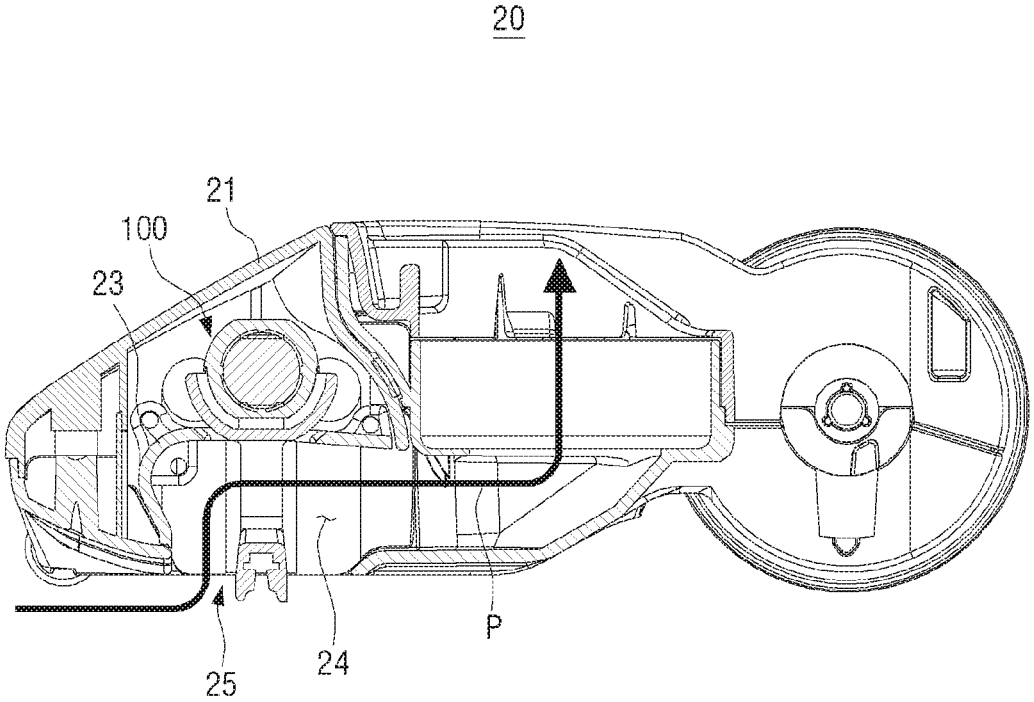
FIG. 6 is a cross-sectional view of a suction nozzle taken along line VI-VI of FIG. 2.

Referring to FIGS. 2, 4, and 6, a suction nozzle 20 includes a housing cover 21, a housing 22, and a suction port 25. The suction port 25 is formed on a bottom surface of the housing 22, and a suction space 24 and a suction flow path P that communicate with the suction port 25 are formed on the inside of the housing 22.

The suction flow path P is a path through which air including pollutants sucked through the suction port 25 moves to a main body 10. Further, in front of the inside of the housing 22, a flow path guide 23 is formed to guide the air entering into the suction space 24 so that the air can pass through a vibration cleaning unit 100.

Referring to FIG. 6, the flow path guide 23 may be formed to be curved so that a lower surface thereof that is adjacent to the suction port 25 has a larger volume than the volume of an upper surface thereof that is positioned far from the suction port 25. However, the shape of the flow path guide 23 is not limited thereto, and any shape that can guide the air to naturally pass through the vibration cleaning unit 100 will suffice.

The vibration cleaning unit 100 is arranged on the inside of the housing 22, and it is arranged in a state where it can vibrate in the suction space 24 that is formed on the suction flow path P.

The vibration cleaning unit 100 has a pollutant inflow space 108 formed therein to make the air including pollutants that flows in through the suction port 25 pass through the vibration cleaning unit 100. Accordingly, the air that has passed through the suction port 25 flows into the suction space 24, and then is guided by the flow path guide 23 to pass through the pollutant inflow space 108.

Hereinafter, the structure of the vibration cleaning unit according to an embodiment of the present disclosure will be described in detail with reference to FIGS. 2 to 5.

Figure 3:
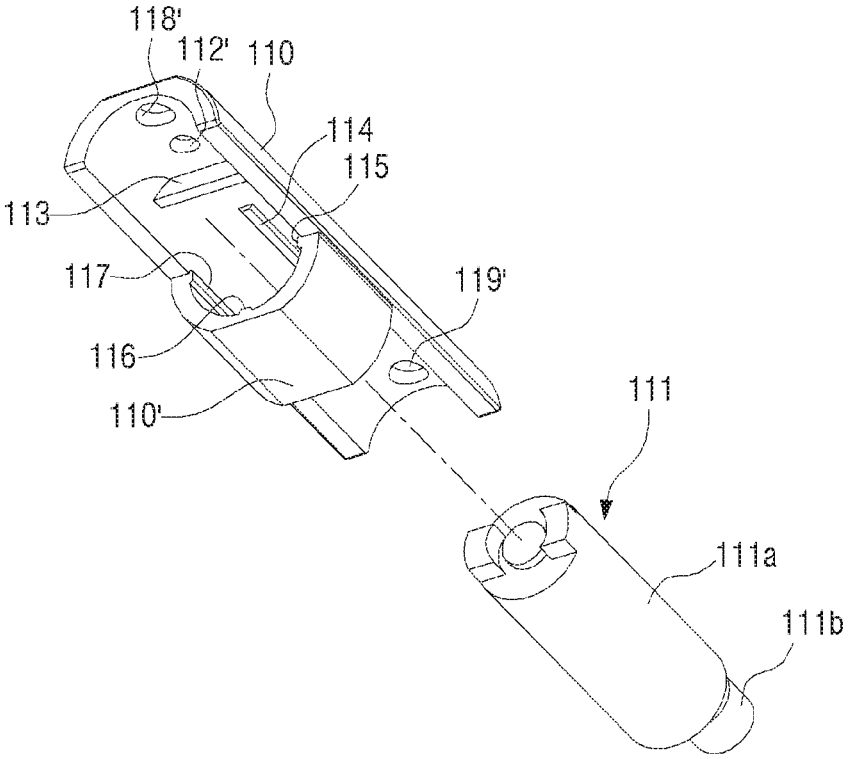
FIG. 3 is a perspective view of a holder mounted in an accommodation groove and a vibration source mounted in the holder as seen from a lower side thereof.
Figure 5:
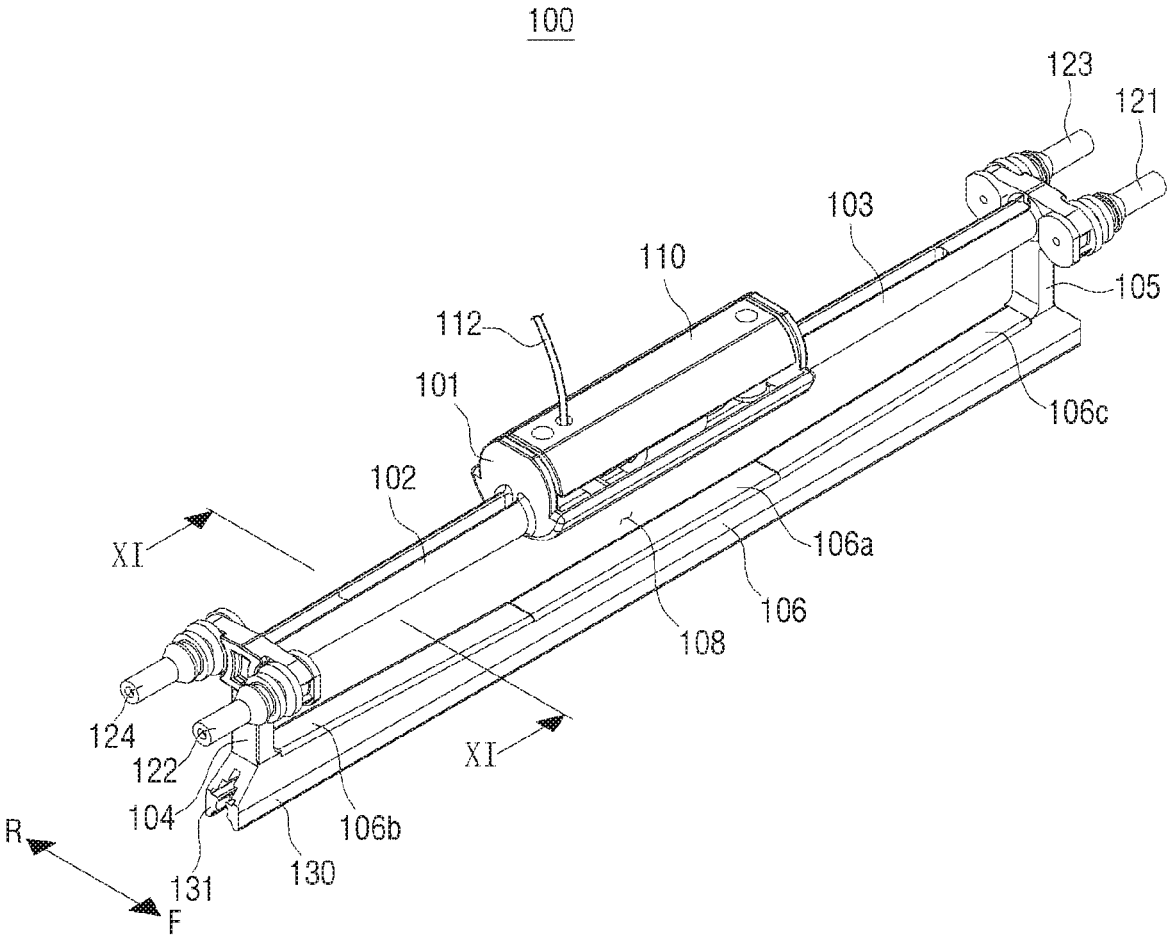
FIG. 5 is a perspective view of a vibration cleaning unit according to an embodiment of the present disclosure.

FIG. 3 is a perspective view of a holder mounted in an accommodation groove and a vibration source mounted in the holder as seen from a lower side thereof, and FIG. 5 is a perspective view of a vibration cleaning unit according to an embodiment of the present disclosure.

Referring to FIG. 5, the vibration cleaning unit 100 according to an embodiment of the present disclosure includes a vibration source 111, vibration transfer frames 102 and 103 on which the vibration source 111 can be arranged, a vibration bar 106 arranged to be spaced apart for a predetermined distance to lower sides of the vibration transfer frames 102 and 103, and connection members 104 and 105 connecting the vibration transfer frames 102 and 103 and the vibration bar 106 to each other.

An upper portion of the vibration cleaning unit 100 is composed of the vibration transfer frames 102 and 103, and an accommodation groove 101 for accommodating the vibration source 111 therein is formed thereon.

The accommodation groove 101 is formed between the vibration transfer frames 102 and 103 to transfer vibration that is generated from the vibration source 111 to the vibration transfer frames 102 and 103, and may be integrally formed.

Further, on the upper portion of the vibration cleaning unit 100, the accommodation groove 101 may not be formed. In this case, the vibration transfer frames 102 and 103 are connected to each other, and the vibration source 111 may be directly fixed to the vibration transfer frames 102 and 103.

Referring to FIG. 3, the vibration source 111 is fixed to a holder 110. The holder 110 fixes the vibration source 111 through contact with the vibration source 111 with a minimum area so as to prevent the vibration source 111 from separating from the accommodation groove 101 while the vibration source 111 vibrates and to transfer the vibration that is generated from the vibration source 111 to the vibration transfer frames 102 and 103. For this, a support member 110' for supporting the vibration source 111 is formed on the holder 110.

The support member 110' has a plurality of support projections 114, 115, 116, and 117 formed thereon that come in direct contact with the vibration source 111 to fixedly support the vibration source 111.

Further, at least one rib 113 is formed in the holder 110 to prevent the vibration source 111 from moving in the length direction of the vibration cleaning unit 100. The vibration source 111 may be stably fixed by the plurality of support projections 114, 115, 116, and 117 and the rib 113 without separating in front, back, left, and right directions from the holder 110.

The holder 110 is mounted in the accommodation groove 101 in a state where the vibration source 111 is coupled to the holder 110. Referring to FIG. 2, two screw holes 118' and 119' are formed on the holder 110, and at least two bosses 118 and 119 are formed in the accommodation groove 101. The holder 110 is coupled to the accommodation groove 101 as the screw holes 118' and 119' and the bosses 118 and 119 are arranged to be aligned, and then screws (not illustrated) are fastened to the screw holes and the bosses.

For convenience in explanation, it is exemplified that the vibration cleaning unit 100 according to an embodiment of the present disclosure uses a vibration motor **111*a* as the vibration source 111**. However, the vibration source may be a vibration actuator so far as it can generate vibration.

Referring to FIGS. 3 and 5, the vibration motor **111*a* is electrically connected to an electricity supply portion (not illustrated) by electric wires 112, and the electric wires 112** electrically connect the electricity supply portion and the vibration motor 111*a* to each other through a hole 112' formed on the holder 110.

The vibration bar 106 is arranged to be spaced apart from the lower sides of the vibration transfer frames 102 and 103, and is connected to the vibration transfer frames 102 and 103 by the connection members 104 and 105. Accordingly, the pollutant inflow space 108 of the vibration cleaning unit 100 is formed by the vibration transfer frames 102 and 103, the vibration bar 106, and the connection members 104 and 105.

The connection members 104 and 105 are formed to extend downward from both ends of the vibration transfer frames 102 and 103 so that air including pollutants passing through the pollutant inflow space 108 can smoothly pass through the same without being interfered with the connection members 104 and 105, but are not limited thereto. The connection members 104 and 105 may extend downward from the accommodation groove 101, or may be formed to extend downward from anywhere between the accommodation groove 101 and the both ends of the vibration transfer frames 102 and 103.

The vibration transfer frames 102 and 103, the connection members 104 and 105, and the vibration bar 106 may be integrally injection-molded. However, the vibration bar 106 may be formed separately from the vibration transfer frames 102 and 103 and the connection members 104 and 105, and in this case, the vibration bar 106 may be fixed to the connection members 104 and 105 through a fastener, such as adhesives or screws.

A center portion 106*a* of the vibration bar 106 may be discontinuous. In this case, because only both ends 106*b* and 106*c* of the vibration bar are connected to the connection member 104 and 105, they vibrate to cause a resonance effect not to occur, and the overall resonance frequency of the vibration bar 106 may be somewhat lowered.

Further, if the center portion 106*a* of the vibration bar is discontinued, the both ends 106*b* and 106*c* of the vibration bar may be connected to each other by an elastic member (not illustrated) having high elasticity in the center portion 106*a* thereof.

In this case, because the both ends 106*b* and 106*c* of the vibration bar are connected to each other by the high-elasticity member, the overall resonance frequency of the vibration bar 106 may be somewhat heightened as compared with the case where the center portion 106*a* is discontinued. However, if the vibration bar 106 is not discontinued, but the center portion 106*a* and the both ends 106*b* and 106*c* are integrally formed, the resonance phenomenon may become maximized.

Accordingly, in order to maximally heighten the resonance frequency, the vibration bar 106 may be integrally formed in the form of a straight line.

The vibration cleaning unit 100 is coupled to the housing 22 to be able to vibrate by a plurality of elastic members 121, 122, 123, and 124.

The plurality of elastic members 121, 122, 123, and 124 elastically support the vibration cleaning unit 100 in a manner that one side of each of the plurality of elastic members is coupled to one internal surface of the housing 22 and the other side thereof is coupled to both ends of the vibration transfer frames 102 and 103.

However, it is not necessary to provide a plurality of elastic members. If the vibration cleaning unit 100 is elastically supported in the housing 22, it is sufficient that at least one elastic member 121, 122, 123, and 124 is coupled to both sides of the vibration cleaning unit 100.

In this case, the elastic members 121, 122, 123, and 124 may be configured to suppress movement of the vibration cleaning unit 100 in a direction that is vertical to a surface to be cleaned and to permit movement of the vibration cleaning unit 100 in a direction that is parallel to the surface to be cleaned, that is, only in front (F) or rear (R) direction that corresponds to a proceeding direction of the suction nozzle.

This is because if the vibration cleaning unit 100 moves in the vertical direction to the surface to be cleaned, an area in which the vibration cleaning unit 100 comes in contact with the surface to be cleaned is minimized to lower the cleaning efficiency.

The plurality of elastic members 121, 122, 123, and 124 may be made of rubber, but are not limited thereto. Any material having elasticity will suffice. Further, the elastic members 121, 122, 123, and 124 may be in the form of a cylinder, and a groove having a predetermined width may be formed at both ends of the elastic members 121, 122, 123, and 124 so that they can be coupled to both sides of the vibration transfer frames 102 and 103 and the housing 22.

The plurality of elastic members 121, 122, 123, and 124 may be composed of coil springs or plate springs.

Referring to FIGS. 4 to 6, the vibration bar 106 is formed along the length direction of the suction port 25, and has a length that is shorter than the length of the suction port 25.

Hereinafter, referring to FIGS. 5, 10A, 10B, and 11, skirts 130 and 131 that are formed on the vibration bar 106 will be described in detail.

Figure 10A:
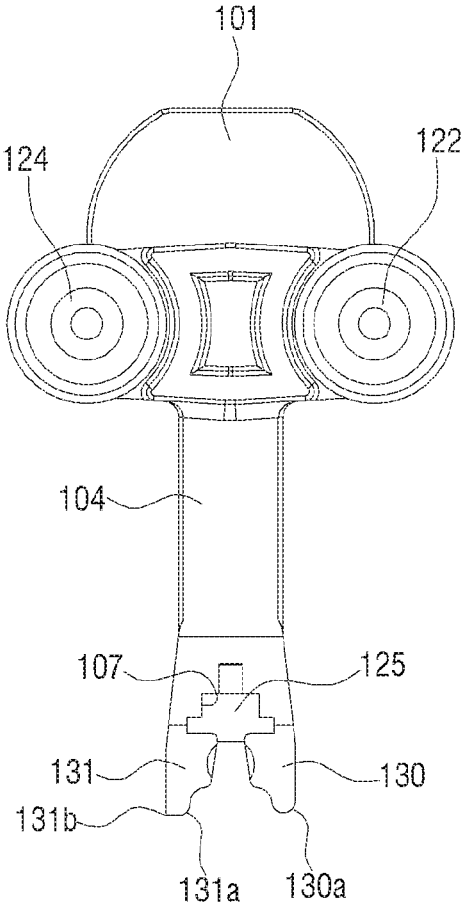
FIGS. 10A and 10B are side views of a vibration cleaning unit according to an embodiment of the present disclosure.
Figure 11:
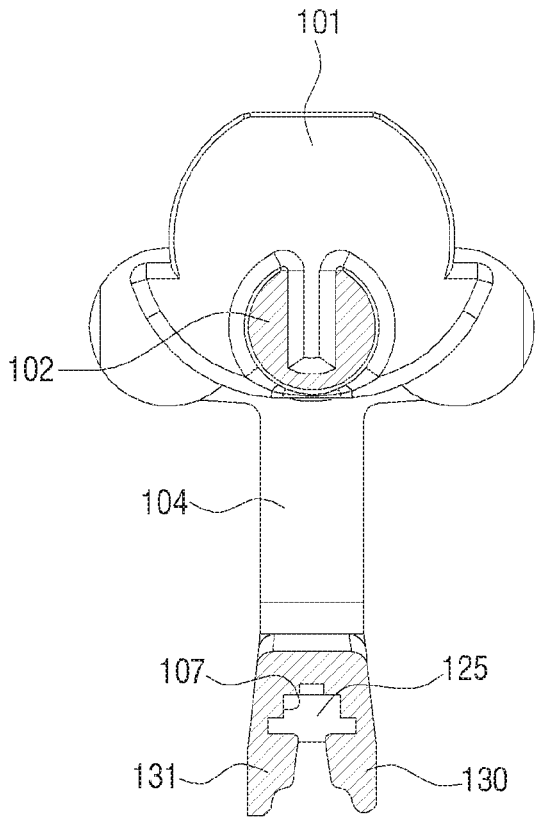
FIG. 11 is a cross-sectional view of a vibration cleaning unit taken along line XI-XI of FIG. 5.

FIG. 10A is a side view of a vibration cleaning unit according to an embodiment of the present disclosure, and FIG. 11 is a cross-sectional view of a vibration cleaning unit taken along line XI-XI of FIG. 5.

The vibration bar 106 according to an embodiment of the present disclosure includes at least one skirt 130 and 131 that comes in contact with a surface to be cleaned. Further, the vibration bar 106 and the skirts 130 and 131 may be integrally formed, and may be formed of a material having elasticity, such as synthetic resin.

If the vibration bar 106 is transformed while resonating, the skirts 130 and 131 are flexed while resonating together with the vibration bar 106.

The skirts 130 and 131 quickly sweep the surface to be cleaned while vibrating in front (F) and rear (R) of the suction nozzle. Through the operation of the skirts 130 and 131 to sweep a bottom surface, dust that is stuck into a carpet is exposed toward an outside of the carpet, and the suction nozzle 20 sucks the exposed dust. Accordingly, a vacuum cleaner or a robot cleaner having the vibration cleaning unit according to this embodiment has very high cleaning efficiency with respect to the surface to be cleaned such as a carpet.

Referring to FIG. 10A, two skirts may be coupled to the lower end of the vibration bar 106. Further, at least one skirt 130 may be arranged toward the front (F) of the suction nozzle on the lower surface of the vibration bar 106, and the other skirt 131 may be arranged toward the rear (R) of the suction nozzle.

The skirt 130 installed in the front (F) may be defined as a front skirt 130.

In this case, the end 130*a* of the front skirt 130 that comes in contact with the surface to be cleaned may be formed to be entirely rounded. This is to minimize damage that may occur on the surface to be cleaned because the vibrating front skirt 130 comes in contact with the surface to be cleaned.

Further, the skirt 131 formed in the rear (R) may be defined as a rear skirt 131. In the case of the rear skirt 131, only one corner 131*a* of the end may be formed to be rounded, and the other corner 131*b* may be formed to be angulated. This is to heighten the cleaning efficiency through widening of a cross-sectional area in which the rear skirt 131 comes in contact with the surface to be cleaned.

A pair of front and rear skirts 130 and 131 formed on the vibration bar 106 may be spaced apart from each other for a predetermined distance. A mount groove 107 in which a separate cleaning member, such as a brush, can be mounted is formed in this predetermined distance.

Due to vibration of the vibration bar 106, fatigue may be continuously accumulated in the mount groove 107 to cause the mount groove 107 to be cracked. Accordingly, a damper 125 may be inserted into the mount groove 107 in order to lighten the structural fatigue that is caused by the vibration of the vibration bar 106.

Further, any one of the front and rear skirts 130 and 131 of the vibration bar 106 may be formed as the brush 126.

Figure 10B:
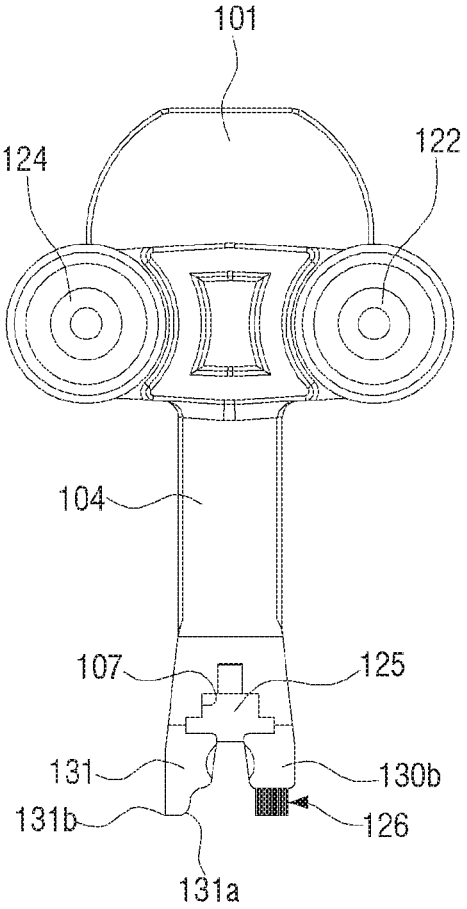

FIG. 10B illustrates such an embodiment. For example, a rear skirt 131 may be formed, and a brush 126 may be mounted on a front portion 130*b*. In contrast, a front skirt 130 may be formed, and a brush 126 may be mounted on a rear portion.

Referring to FIG. 11, the cross section of the vibration transfer frames 102 and 103 may be in any one shape of "U", "H", and a straight line in order to well transfer the vibration, to increase an amplitude through maximization of the resonance frequency, and to secure structural stiffness against a shape change due to continuous vibration.

Because the shape of the vibration cleaning unit is transformed by the vibration, there may be a problem in durability. From this viewpoint, the accommodation portion 101, the vibration transfer frames 102 and 103, the connection members 104 and 105, and the vibration bar 106, which constitute the vibration cleaning unit, may be made of a metal having elasticity. In particular, they may be made of stainless steel that corresponds to a metal having elasticity and excellent corrosion resistance.

However, in order to save the manufacturing cost, the above-described configurations may be formed of a synthetic resin material, such as plastic.

Hereinafter, referring to FIGS. 7 to 9C, a vibration process through resonance of a vibration cleaning unit 100 according to an embodiment of the present disclosure will be described in detail.

Figure 7:
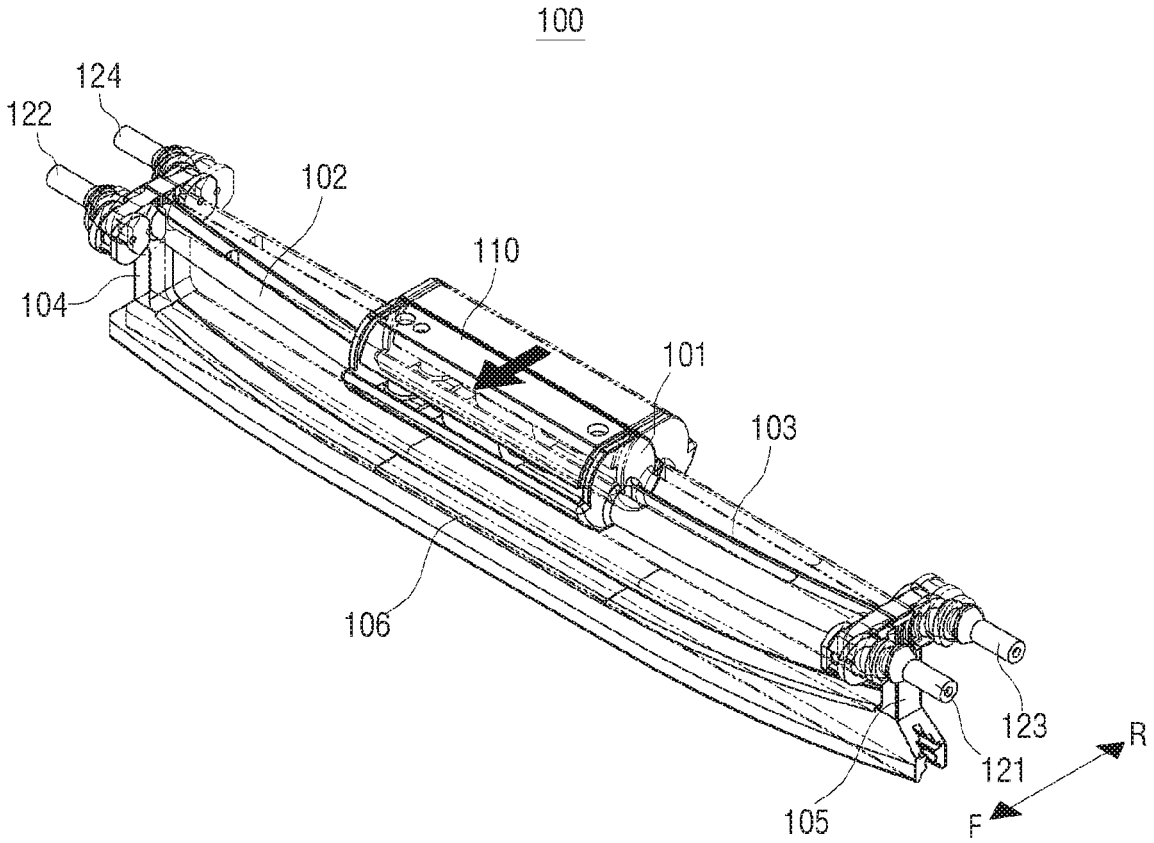
FIGS. 7 and 8 are views explaining a state where a vibration cleaning unit is transformed forward and rearward as resonating with a vibration source according to an embodiment of the present disclosure.
Figure 8:
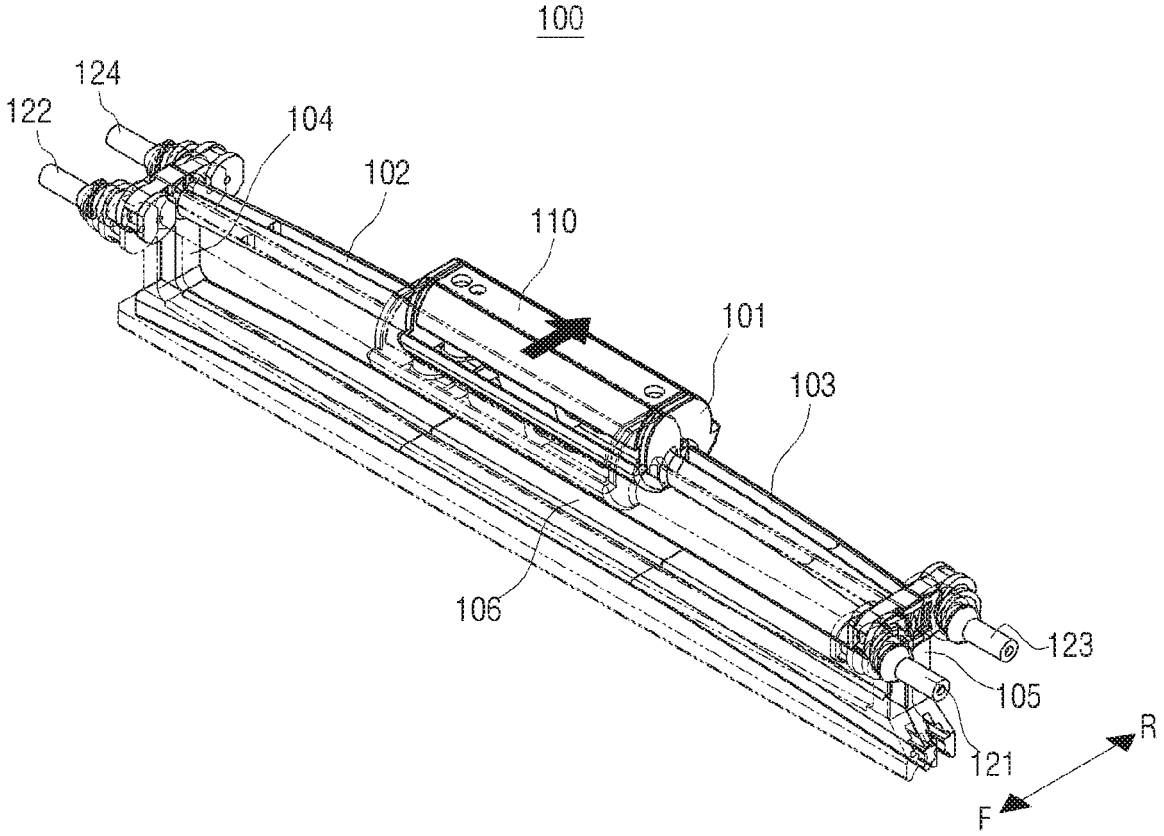
Figure 9A:
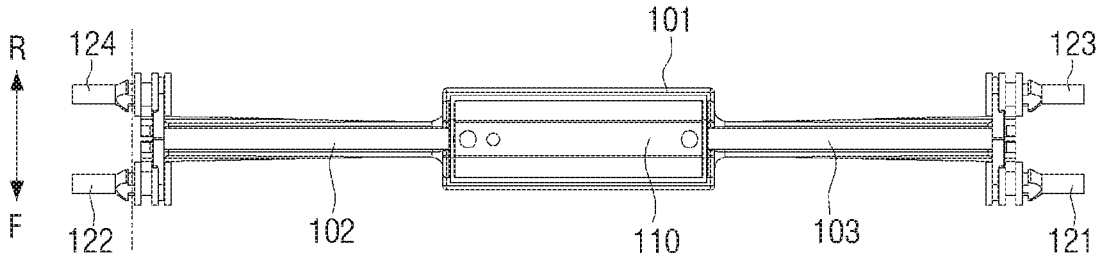
FIGS. 9A, 9B, and 9C are plan views explaining a state where a vibration cleaning unit is transformed forward and rearward as resonating with a vibration source according to an embodiment of the present disclosure.
Figure 9B:
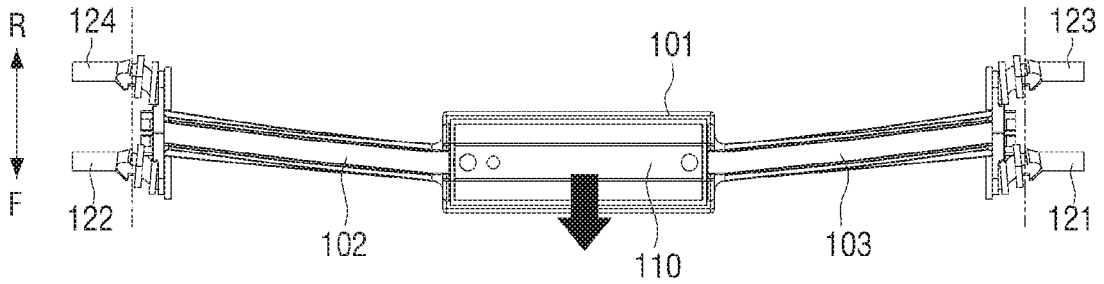
Figure 9C:
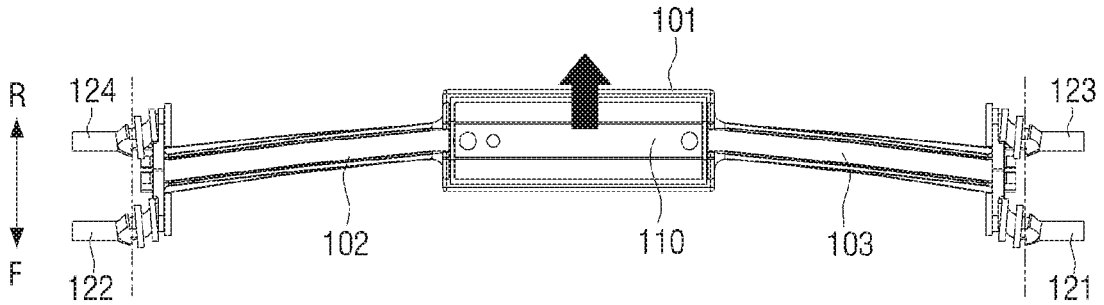

FIGS. 7 and 8 are views explaining a state where a vibration cleaning unit is transformed forward and rearward as resonating with a vibration source according to an embodiment of the present disclosure, and FIGS. 9A to 9C are plan views explaining a state where a vibration cleaning unit is transformed forward and rearward as resonating with a vibration source according to an embodiment of the present disclosure.

If a vibration motor 111*a* receives a power that is supplied from an electricity supply portion, a driving portion 111*b* installed on the vibration motor 111*a* is rotated.

The driving portion 111*b* is installed to be eccentric from a center shaft of the vibration motor 111*a*. Accordingly, if the driving portion 111*b* is rotated, an eccentric force is generated to make the vibration motor 111*a* vibrate.

Because the holder 110 fixes the vibration motor 111*a* so that the vibration motor 111*a* does not separate therefrom using the support member 110', vibration of the vibration motor 111*a* is transferred to the holder 110 through the support member 110'.

The accommodation groove 101 is screw-engaged with the holder 110 and vibrates with the same frequency as the frequency of the vibration motor 111*a*.

As the accommodation groove 101 vibrates, the vibration of the vibration motor 111*a* is transferred to the vibration transfer frames 102 and 103 connected to both sides of the accommodation groove, and the vibration transfer frames 102 and 103 vibrate through such vibration.

Because the vibration transfer frames 102 and 103 have elasticity, they can transfer the vibration in the length direction of the suction port 25. In this case, the vibration frequency of the vibration motor 111*a* that is transferred to the vibration transfer frames 102 and 103 is amplified.

If the vibration transfer frames 102 and 103 causes such a resonance phenomenon to occur, the amplitude becomes maximized at both ends of the vibration transfer frames 102 and 103.

The amplified vibration is transferred to the plurality of elastic members 121, 122, 123, and 124 that are partially coupled to the both ends of the vibration transfer framed 102 and 103. Further, connection portions of the plurality of elastic members 121, 122, 123, and 124, which connect the housing 22 and the vibration transfer frames 102 and 103, are transformed.

Further, the amplified vibration is also transferred to the vibration bar 106 that is formed to be spaced apart from the lower sides of the vibration transfer frames 102 and 103 through the connection members 104 and 105.

Both ends 106*b* and 106*c* of the vibration bar vibrate together with the vibration transfer frames 102 and 103 by the vibration transferred from the vibration transfer frames 102 and 103.

The vibration bar 106 also has elasticity, and the shape of the vibration bar 106 is changed by the vibration. As the both ends 106*b* and 106*c* of the vibration bar are pulled or pushed by the vibration, the center portion 106*a* of the vibration bar 106 is also transformed.

Because the vibration of the vibration motor 111*a* is transferred to the vibration bar 106 by the vibration transfer frames 102 and 103, the degree and the size of deformation of the vibration bar 106 are determined by the vibration frequency of the vibration motor 111*a*.

Further, the vibration frequency of the vibration motor 111*a* is transferred and resonates through the vibration transfer frames 102 and 103 to become higher. Accordingly, the vibration frequency of the vibration bar 106 is generally higher than the vibration frequency of the vibration motor 111*a*.

Through such a resonance phenomenon, the center portion 106*a* of the vibration bar is flexed in the proceeding direction of the suction nozzle 20. The proceeding direction of the suction nozzle 20 may be divided into front (F) and rear (R) directions, and is the same as the direction of an arrow illustrated in FIGS. 7 to 9C.

The center portion 106*a* of the vibration bar 106 is formed to be thinner than the both ends 106*b* and 106*c* of the vibration bar. This is to maximize the amplitude in the center portion 106*a*.

Further, the center portion 106*a* of the vibration bar is formed to be closer to the surface to be cleaned than the both ends 106*b* and 106*c* of the vibration bar.

This is to smoothly suck pollutants having large volume or weight, such as popcorn, rice, or small stones, into the pollutant inflow space 108 that is formed in the vibration cleaning unit.

That is, by setting a low height of the center portion 106*a* of the vibration bar against the surface to be cleaned, pollutants having large volume can easily go over the center portion 106*a* of the vibration bar.

In the vibration cleaning unit 100 according to an embodiment of the present disclosure, the vibration frequency of the vibration motor 111*a* that is the vibration source 111 is amplified by the vibration transfer frames 102 and 103, the elastic members 121, 122, 123, and 124 and the vibration bar resonate with each other, and the amplitude is maximized at the vibration transfer frames 102 and 103 and the both ends 106*b* and 106*c* of the vibration bar.

Referring to FIGS. 7 and 9B, if the vibration direction of the vibration motor 111*a* is the front (F) direction, the vibration transfer frames 102 and 103 and the vibration bar 106 are flexed toward the front (F). Further, the elastic members 121, 122, 123, and 124 are also flexed toward the same direction as the vibration transfer frames 102 and 103 and the vibration bar 106.

Referring to FIGS. 8 and 9C, if the vibration direction of the vibration motor 111*a* is the rear (R) direction, the vibration transfer frames 102 and 103 and the vibration bar 106 are flexed toward the rear (R). Further, the elastic members 121, 122, 123, and 124 are also flexed toward the same direction as the vibration transfer frames 102 and 103 and the vibration bar 106.

As described above, the vibration cleaning unit 100 according to an embodiment of the present disclosure can be driven with low power using the resonance phenomenon amplifying the vibration of the vibration source 111 as transferring the same through the vibration transfer frames 102 and 103.

Further, as the vibration is maximized at the both ends 106*b* and 106*c* of the vibration bar, the vibration cleaning unit can vibrate at very high speed.

As compared with the vacuum cleaner and the robot cleaner in the related art, which drive the motor at several thousands of rpm through supply of high power of several tens of watts to rotate the brush, the suction nozzle 20 having the vibration cleaning unit 100, and the vacuum cleaner and the robot cleaner including the same according to an embodiment of the present disclosure can heighten the cleaning efficiency and reduce power consumption.

Because the vibration cleaning unit 100 according to an embodiment of the present disclosure vibrates using the resonance phenomenon, it is not necessary to be provided with components, such as a belt, gear, and bearing, used in the type in the related art using a rotary brush. Accordingly, the vibration cleaning unit 100 according to an embodiment of the present disclosure has a simple structure, facilitates maintenance and repair, and greatly saves the manufacturing cost.

Figure 12:
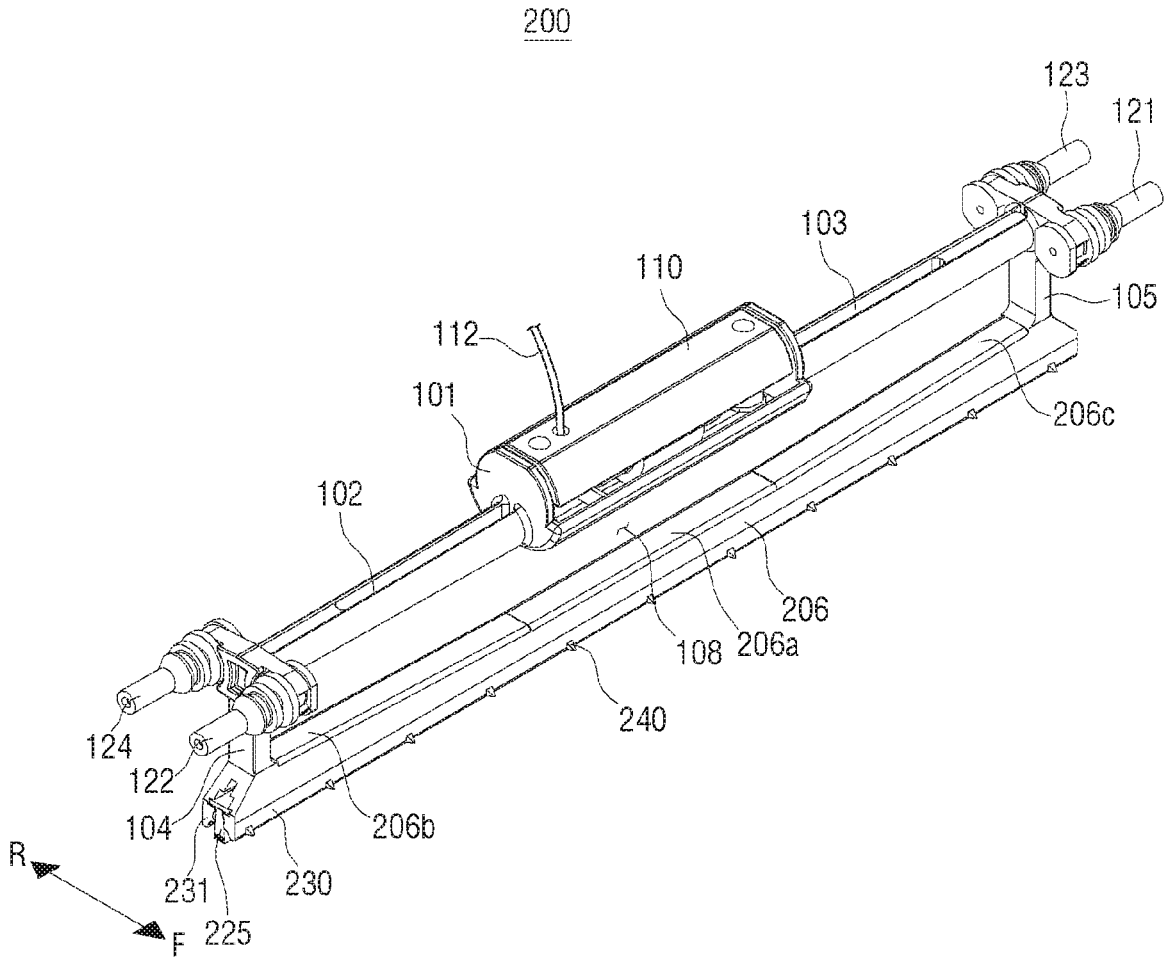
FIG. 12 is a perspective view of a vibration cleaning unit according to an embodiment of the present disclosure.
Figure 13:
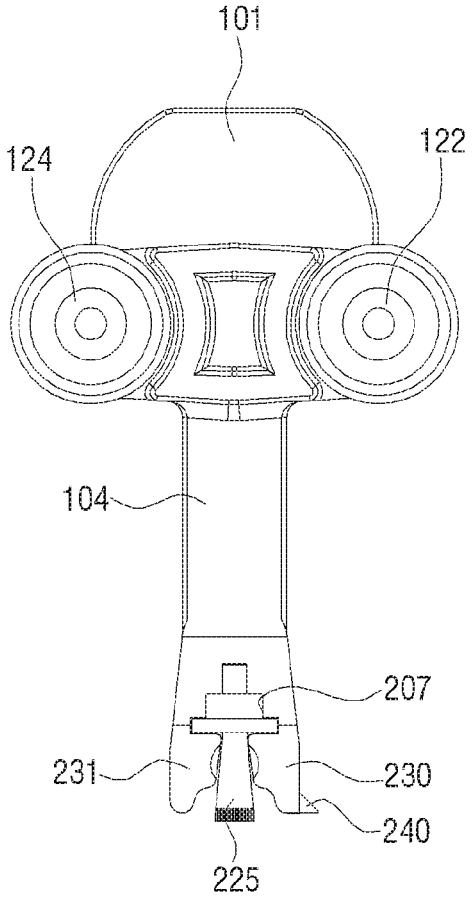
FIG. 13 is a side view of a vibration cleaning unit according to an embodiment of the present disclosure.

Referring to FIGS. 12 and 13, the configuration of a vibration cleaning unit 200 according to an embodiment of the present disclosure will be described in detail.

Because the vibration cleaning unit 200 according to an embodiment of the present disclosure is different from the vibration cleaning unit 100 according to an embodiment of the present disclosure only on the point of the configuration of a vibration bar, explanation will be made with respect to the configuration of the vibration bar only, but explanation of the same configurations will be omitted.

FIG. 12 is a perspective view of a vibration cleaning unit according to an embodiment of the present disclosure, and FIG. 13 is a side view of a vibration cleaning unit according to an embodiment of the present disclosure.

Skirts 230 and 231 that are formed on a vibration cleaning unit 200 according to an embodiment of the present disclosure are arranged for a predetermined distance along a lower portion of one surface of the skirts 230 and 231, and may additionally include a plurality of projections 240 that come in contact with a surface to be cleaned.

The projections 240 are formed on a front surface of a lower portion of the skirts 230 and 231, and may be formed to project toward the front (F) of the suction nozzle 20.

The projections 240 may be formed in the shape of a triangular pyramid in order to take off hair among pollutants sucked through the suction nozzle 20 from the surface to be cleaned and to separate the hair into hair strands. However, the shape of the projections 240 is not limited thereto, but any shape that can take off hair among pollutants stuck on the surface to be cleaned and separate the hair into strands will suffice.

The hair existing on the surface to be cleaned is separated into the hair strands by the projections 240, and the hair strands are not tangled on the vibration cleaning unit 200 arranged on the inside of the suction nozzle 20. That is, the projections 240 serves to prevent the hair from being tangled on the vibration transfer frames 102 and 103, the accommodation groove 101, the connection members 104 and 105, and the vibration bar 206.

FIG. 12 illustrates that the projections 240 are formed on the front skirt 230 only. However, the projections 240 may also be formed on both the front and rear skirts 230 and 231.

A pair of skirts 230 and 231 formed on the vibration bar 206, having a center portion 206*a* and end portions 206*b* and 206*c*, is formed in the front and the rear for a predetermined distance. A mount groove 207 in which a separate cleaning member, such as a brush 225, can be mounted is formed in this predetermined distance.

The brush 225 may be formed of soft fine bristles, and may be slide-fastened to the mount groove 207.

If a pair of skirts 230 and 231 vibrates to strike the surface to be cleaned, pollutants and dust that are stuck into strands of a carpet become exposed. The brush 225 may adsorb or gather the pollutants or dust in a predetermined position to suck them well through the suction port 25.

The vibration cleaning unit 200 according to an embodiment of the present disclosure maximizes the cleaning efficiency for the surface to be cleaned through the brush 225.

Figure 14:
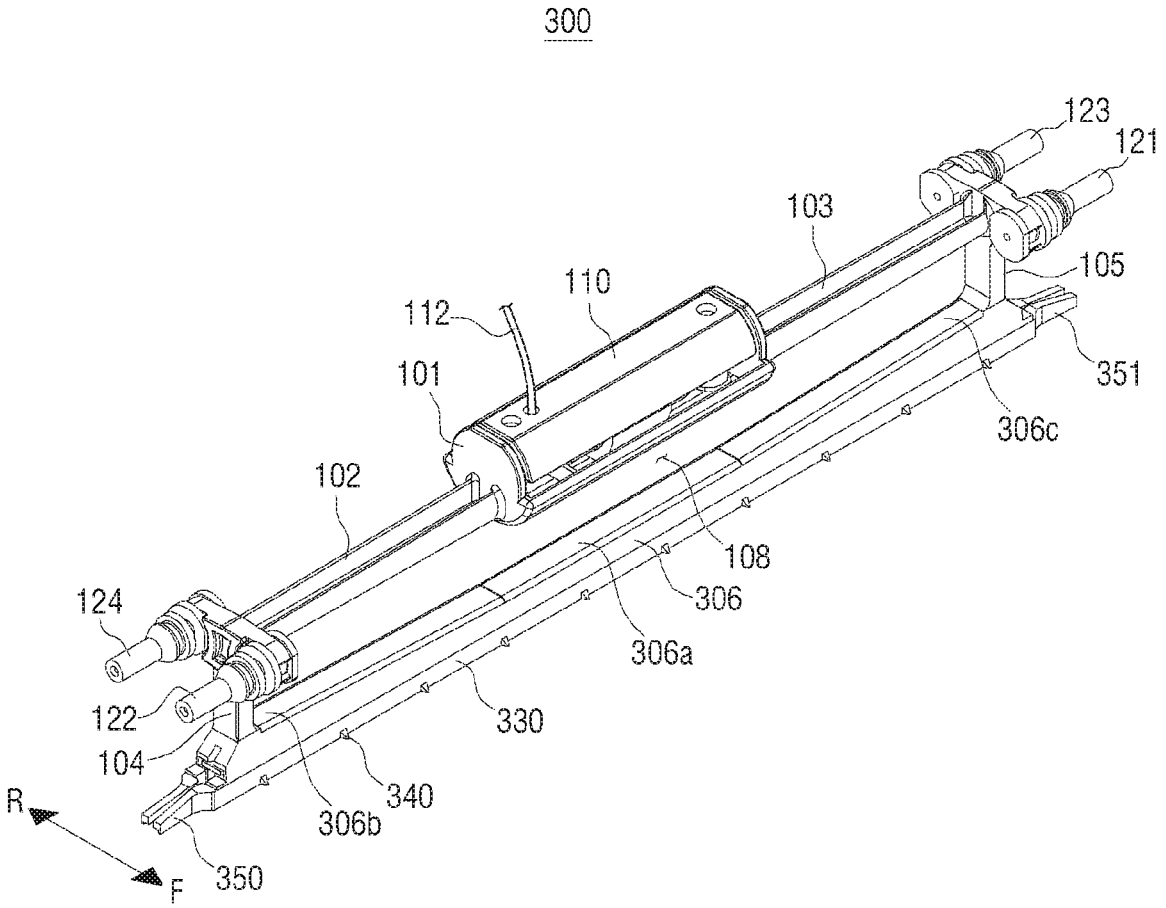
FIG. 14 is a perspective view of a vibration cleaning unit according to an embodiment of the present disclosure.
Figure 15:
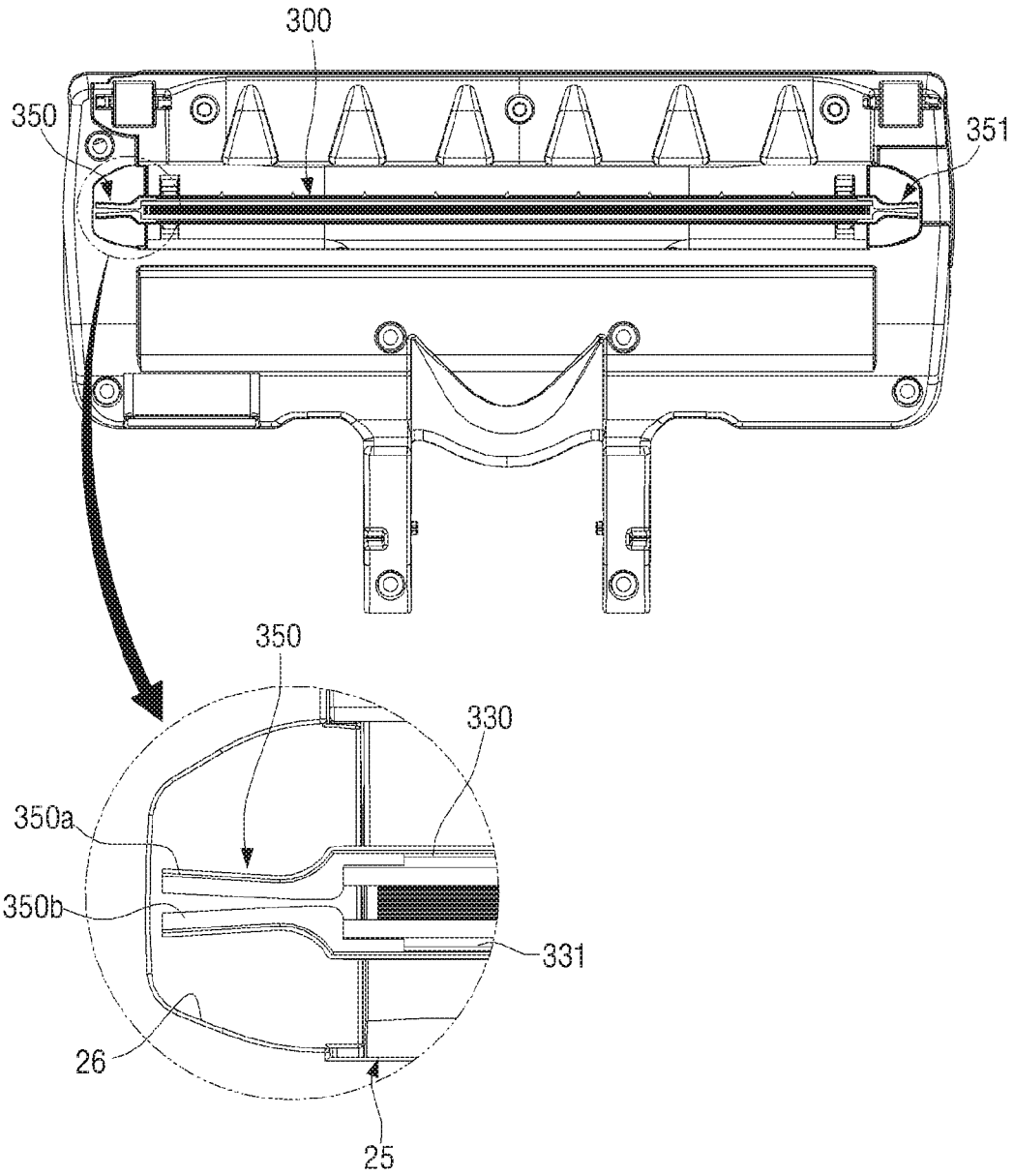
FIG. 15 is a view of a suction nozzle having a vibration cleaning unit mounted thereon as seen from a bottom according to an embodiment of the present disclosure.

Referring to FIGS. 14 and 15, the configuration of a vibration cleaning unit 300 according to an embodiment of the present disclosure will be described in detail.

Because the vibration cleaning unit 300 according to an embodiment of the present disclosure is different from the vibration cleaning unit 100 according to an embodiment of the present disclosure only on the point of the configuration of a vibration bar, explanation will be made with respect to the configuration of the vibration bar only, but explanation of the same configurations will be omitted.

FIG. 14 is a perspective view of a vibration cleaning unit according to an embodiment of the present disclosure, and FIG. 15 is a view of a suction nozzle having a vibration cleaning unit mounted thereon as seen from a bottom according to an embodiment of the present disclosure.

Referring to FIGS. 14 and 15, a vibration bar 306 according to an embodiment of the present disclosure further includes at least one extension portion 350 and 351 formed to extend from both ends 306*b* and 306*c* of the vibration bar, respectively, and an extension groove 26 for accommodating the extension portions 350 and 351 is formed on both sides of the suction port 25 of the suction nozzle 30.

The at least one extension groove 26 communicates with the suction port 25. Accordingly, dust and pollutants that flow into the extension groove 26 move through the suction port 25, and are sucked into a vacuum cleaner and a robot cleaner along a suction flow path P.

Because the extension portions 350 and 351 and the extension groove 26 are formed as described above, the vibration bar 306 can approach even a cornered region that the vibration cleaning unit 100 according to an embodiment of the present disclosure cannot approach. Accordingly, the vibration cleaning unit 300 according to an embodiment of the present disclosure, and a vacuum cleaner and a robot cleaner having the same have a wide cleaning range.

The extension portions 350 and 351 are integrally formed with the vibration bar 306, and can be collectively injection-molded by a synthetic resin material.

A pair of skirts 330 and 331 may be integrally formed at a lower end of the vibration bar 306, and at least one extension portion 350 and 351 is formed from one end of the skirts 330 and 331.

One extension portion 350 extends from the pair of skirts 330 and 331, and is composed of first and second extension portions 350*a* and 350*b* that are symmetric to each other.

The first extension portion 350*a* and the second extension portion 350*b* are formed to be spaced apart for a predetermined distance from each other, and individually vibrate through the vibration of the vibration bar 306.

Because the amplitude at both ends 306*b* and 306*c* of the vibration bar is smaller than the amplitude that occurs in the center portion 306*a* of the vibration bar, the cleaning efficiency with respect to the surface to be cleaned may be reduced as the amplitude of the extension portion 350 becomes smaller.

However, because the first extension portion 350*a* and the second extension portion 350*b* respectively vibrate, the extension portion 350 doubly sweeps the surface to be cleaned, so that the cleaning efficiency for the surface to be cleaned is maintained very high at both ends 306*b* and 306*c* of the vibration bar and the extension portion 350.

The skirts 330 and 331 are arranged for a predetermined distance along a lower portion of one surface of the skirts, and may additionally include a plurality of projections 340 that come in contact with the surface to be cleaned.

The projections 340 are formed on the front surface of the lower portion of the skirts 330 and 331, and may be formed to project toward the front (F) of the suction nozzle 30.

FIG. 14 illustrates that the projections 340 are formed on the front skirt 330 only. However, the projections 340 may also be formed on both the front and rear skirts 330 and 331.

A pair of skirts 330 and 331 is formed in the front and the rear for a predetermined distance from the lower end of the vibration bar 306. In this case, a mount groove (not illustrated) in which a separate cleaning member, such as a brush (not illustrated), can be mounted, is formed in this distance.

As described above, because the vibration cleaning unit 300 according to an embodiment of the present disclosure further includes the extension portions 350 and 351, the plurality of projections 340, and the brush (not illustrated), a wider surface to be cleaned can be cleaned, and the cleaning efficiency for the surface to be cleaned can be maximized.

Figure 16:
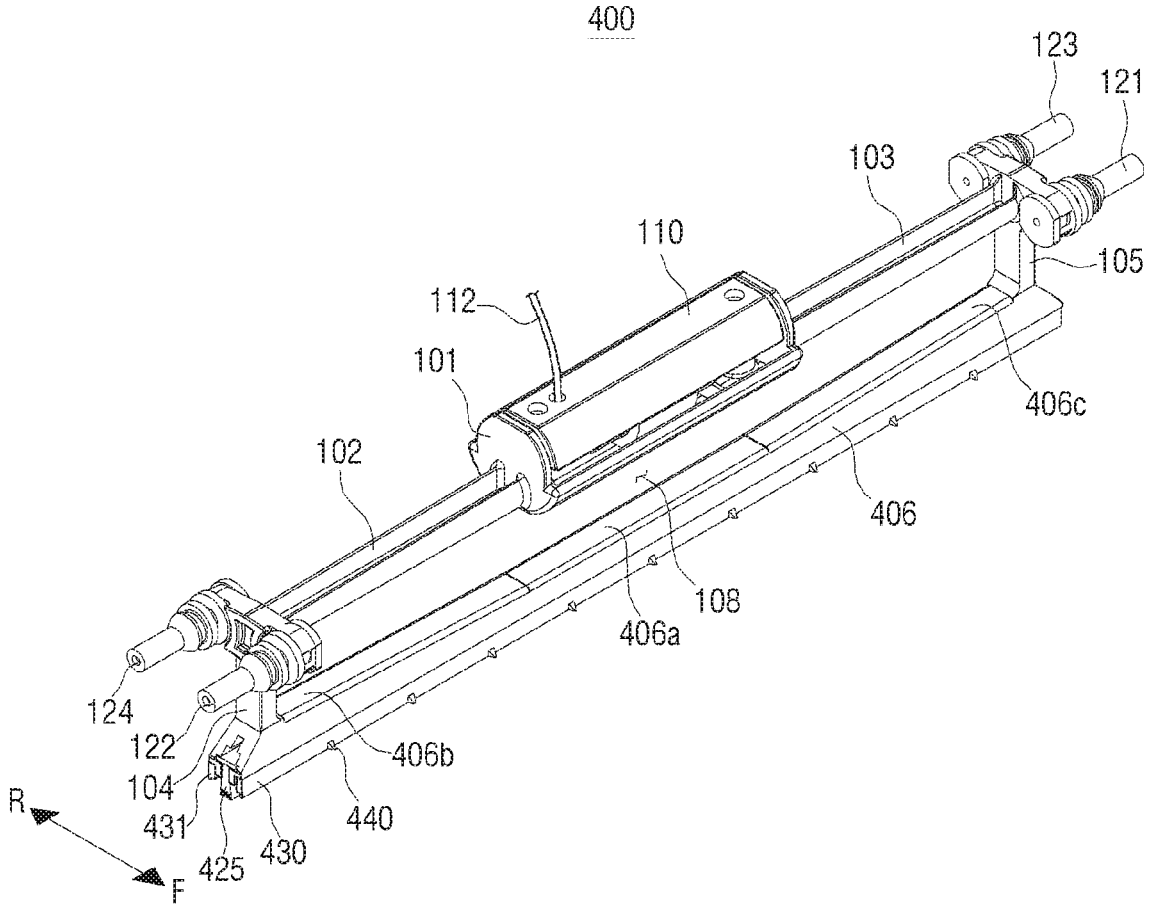
FIG. 16 is a perspective view of a vibration cleaning unit according to an embodiment of the present disclosure.
Figure 17:
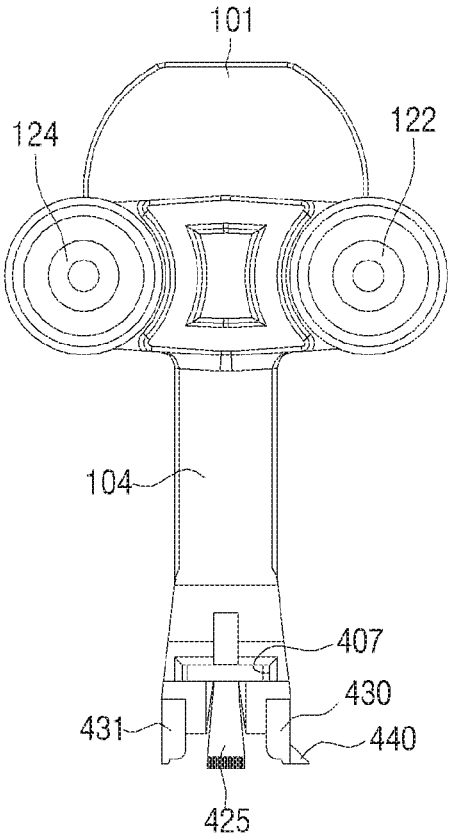
FIG. 17 is a side view of a vibration cleaning unit according to an embodiment of the present disclosure.

Referring to FIGS. 16 and 17, the configuration of a vibration cleaning unit 400 according to an embodiment of the present disclosure will be described in detail.

Because the vibration cleaning unit 400 according to an embodiment of the present disclosure is different from the vibration cleaning unit 100 according to an embodiment of the present disclosure only on the point of the configuration of a vibration bar, explanation will be made with respect to the configuration of the vibration bar only, but explanation of the same configurations will be omitted.

FIG. 16 is a perspective view of a vibration cleaning unit according to an embodiment of the present disclosure, and FIG. 17 is a side view of a vibration cleaning unit according to an embodiment of the present disclosure.

Referring to FIGS. 16 and 17, a vibration bar 406, having a center portion 406*a* and end portions 406*b* and 406*c*, according to an embodiment of the present disclosure may further include at least one rubber blade 430 and 431 coupled along a lower end of the vibration bar.

The rubber blades 430 and 431 may be made of a material that is different from the material of the vibration bar 406, and have higher elasticity than that of the skirts 130 and 131 according to an embodiment of the present disclosure to minimize damage of a surface to be cleaned.

Further, the rubber blades 430 and 431 have high absorption force with respect to dust or pollutants as compared with the skirts 130 and 131 according to an embodiment of the present disclosure, and thus can heighten the cleaning efficiency of the vibration cleaning unit.

The at least one rubber blade 430 and 431 may be arranged at a lower end of the vibration bar 406 to be directed to the front (F) and the rear (R) of the vibration cleaning unit 400. In this case, there may be a distance between the pair of rubber blades 430 and 431, and a mount groove 407 in which a separate cleaning member, such as a brush 425, can be mounted is formed in this predetermined distance.

The brush 425 may be slidably mounted in the mount groove 407.

Further, a plurality of projections 440 may be further formed to be arranged at intervals along a lower portion of one surface of the rubber blades 430 and 431.

The projections 440 are formed on a front surface of a lower portion of the rubber blades 430 and 431, and may be formed to project toward the front (F) of the suction nozzle 20.

The vibration cleaning unit 400 according to an embodiment of the present disclosure includes the plurality of projections 440 and the brush 425, and thus has high cleaning efficiency with respect to the surface to be cleaned.

Figure 18A:
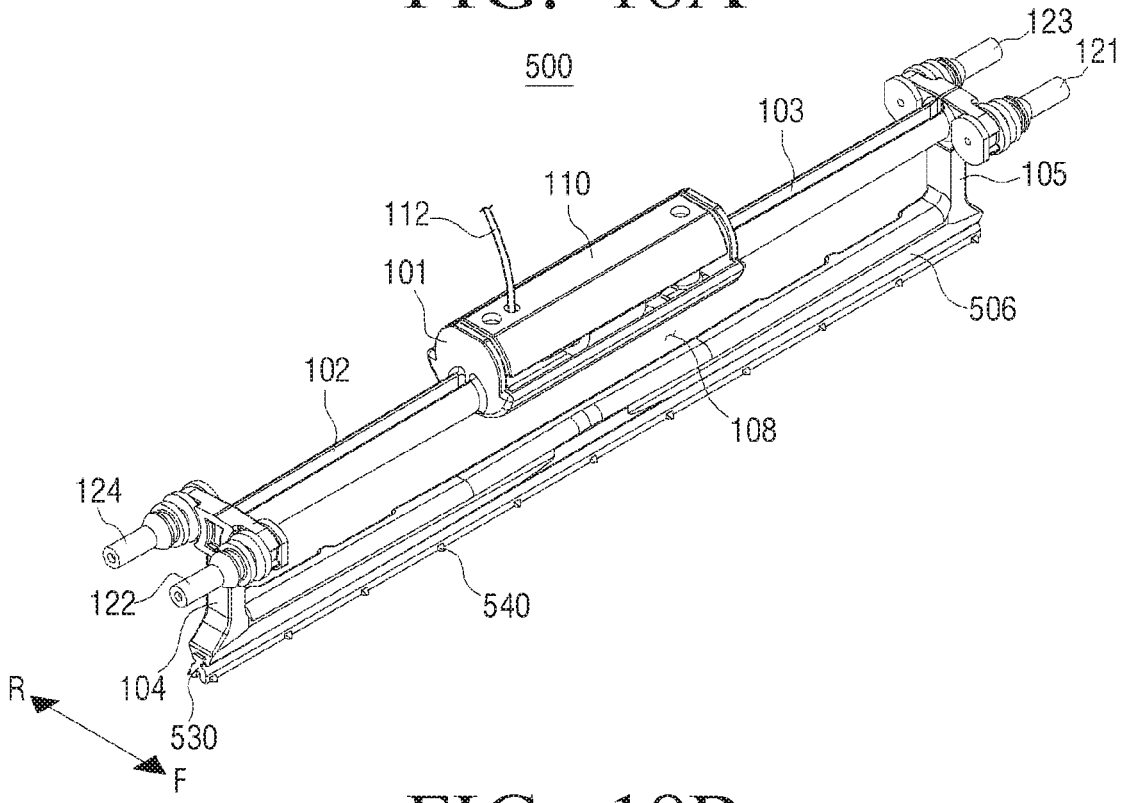
FIGS. 18A and 18B are perspective views of a vibration cleaning unit as seen from various angles according to an embodiment of the present disclosure.
Figure 18B:
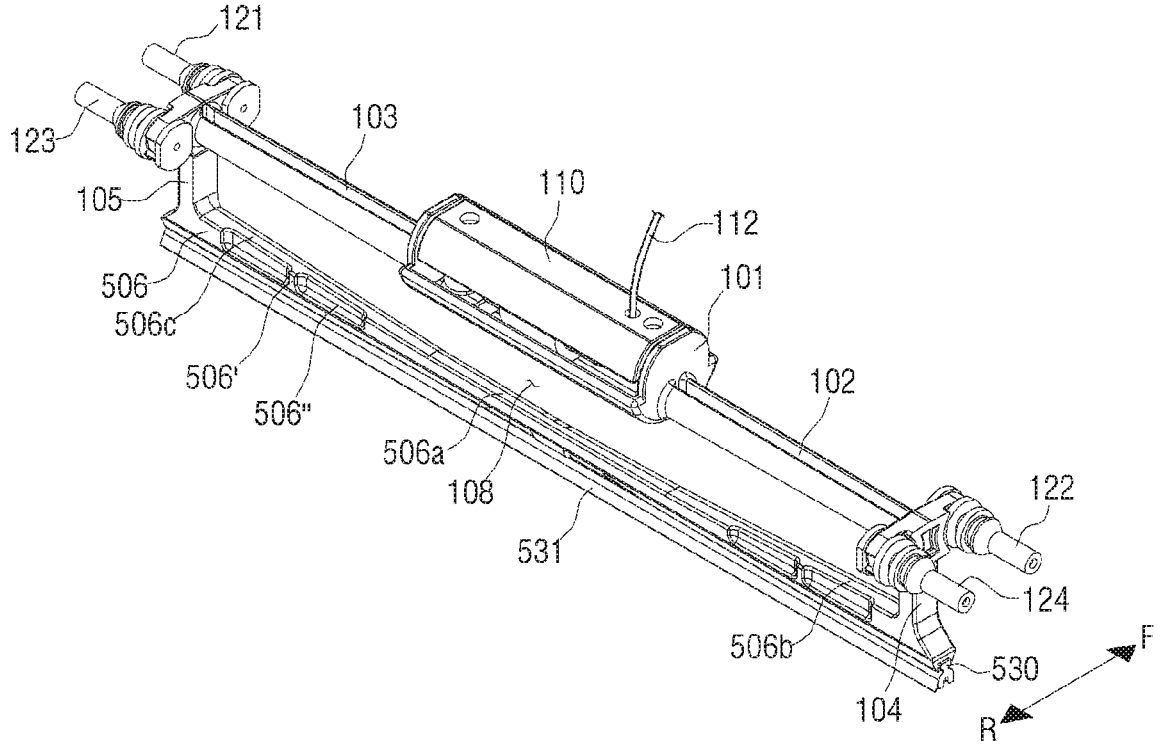
Figure 19:
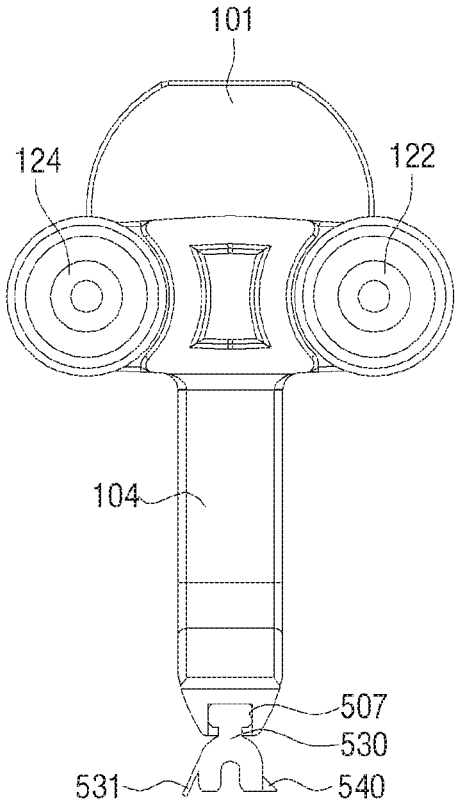
FIG. 19 is a side view of a vibration cleaning unit according to an embodiment of the present disclosure.

Referring to FIGS. 18A to 19, the configuration of a vibration cleaning unit 500 according to an embodiment of the present disclosure will be described in detail.

Because the vibration cleaning unit 500 according to an embodiment of the present disclosure is different from the vibration cleaning unit 100 according to an embodiment of the present disclosure only on the point of the configuration of a vibration bar, explanation will be made with respect to the configuration of the vibration bar only, but explanation of the same configurations will be omitted.

FIGS. 18A to 18C are perspective views of a vibration cleaning unit as seen from various angles according to an embodiment of the present disclosure, and FIG. 19 is a side view of a vibration cleaning unit according to an embodiment of the present disclosure.

Referring to FIGS. 18A to 19, a vibration bar 506, having a center portion 506*a* and end portions 506*b* and 506*c*, according to an embodiment of the present disclosure may include a pair of rubber blades 530 coupled to a groove 507 that is formed at a lower end thereof and an auxiliary blade 531 that projects downward farther than the pair of rubber blades 530.

In this case, the pair of rubber blades 530 is integrally formed, and is slidably coupled to the groove 507 that is formed at a lower end of the vibration bar 506. Further, the auxiliary blade 531 may also be integrally formed with the pair of rubber blades 530.

The auxiliary blade 531 projects downward farther than the pair of rubber blades 530. Through this, the vibration cleaning unit 500 according to this embodiment can maximize a contact area with the surface to be cleaned.

Further, the auxiliary blade 531 projects toward the rear (R) of the vibration cleaning unit 500, and does not disturb the movement of the vibration cleaning unit 500 to the front (F) during vibration of the vibration cleaning unit 500. Accordingly, the auxiliary blade 531 does not exert an influence on the vibration speed of the vibration cleaning unit 500.

On one surface of the blade that is directed to the forefront between the pair of rubber blades 530 integrally formed, a plurality of projections 540 arranged at intervals along a lower portion may be further formed.

The projections 540 may be formed to project toward the front (F) of the suction nozzle 20.

The plurality of projections 540 prevent hair from being tangled on the rubber blades 530, the groove 507 formed at the lower end of the vibration bar, the vibration transfer frames 102 and 103, the accommodation groove 101, the connection members 104 and 105, and the vibration bar 506.

Upper portions of the rubber blades 530 are integrally formed, and are coupled to the groove 507 formed at the lower end of the vibration bar 506. Because each blade is made of rubber, it has excellent adsorption force with respect to pollutants and dust on the surface to be cleaned, and does not cause a damage on the surface to be cleaned when sweeping the surface to be cleaned.

Accordingly, the vibration cleaning unit 500 according to an embodiment of the present disclosure has high cleaning efficiency with respect to the surface to be cleaned.

On the vibration bar 506 of the vibration cleaning unit 500 according to this embodiment, a groove 506" is formed. The groove 506", which is formed for a predetermined distance in the length direction of the vibration bar 506 on a surface on which the vibration bar 506 is directed to the rear (R), is formed by cutting a part of the rear surface of the vibration bar 506.

Further, on one side of the groove 506", a convex portion 506' is formed.

The groove 506" serves to adjust the thickness of the vibration bar 506. If the groove 506" is formed, the thickness of the vibration bar 506 generally becomes thin, and in particular, the thickness of the both ends 506*b* and 506*c* of the vibration bar is reduced.

In this case, the vibration frequency that is generated from the vibration motor 111 is more greatly amplified at both ends 506*b* and 506*c* of the vibration bar, and the resonance effect becomes maximized by the amplified frequency.

Further, if the vibration bar 506 is injection-molded to form the groove 506", a raw material for manufacturing the vibration bar 506 is reduced, and thus the manufacturing cost of the vibration cleaning unit 500 can be saved.

Figure 20A:
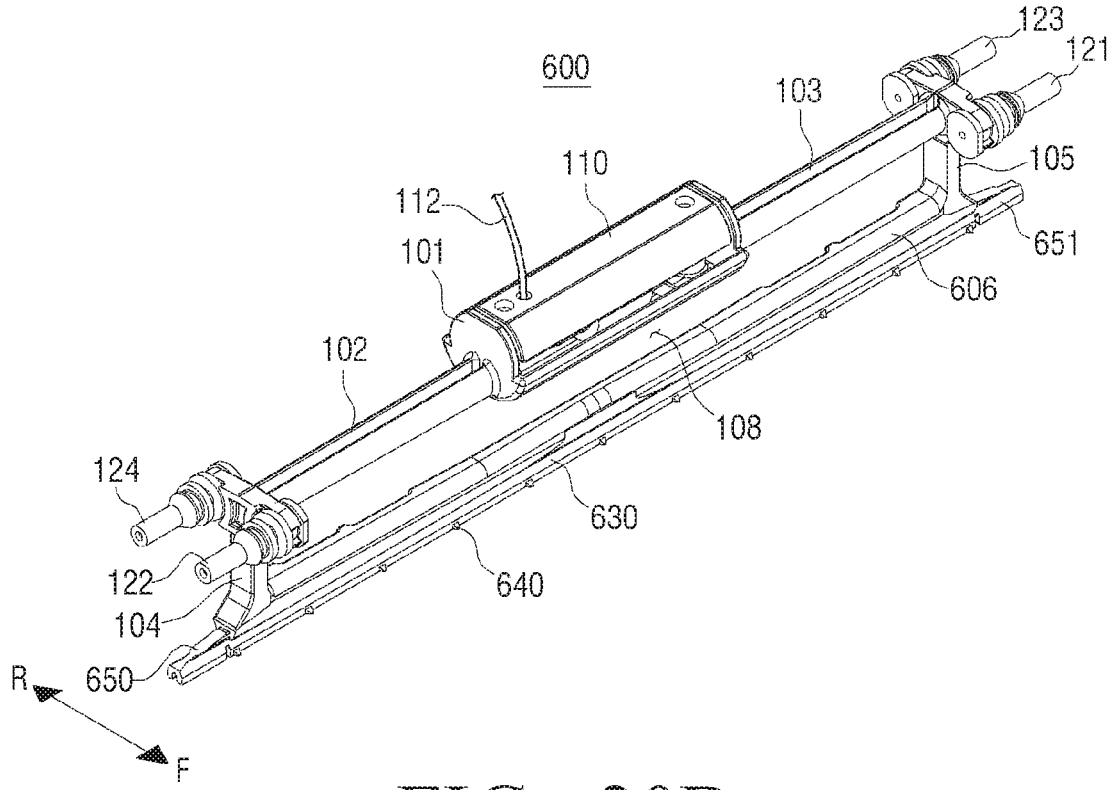
FIGS. 20A and 20B are perspective views of a vibration cleaning unit as seen from various angles according to an embodiment of the present disclosure.
Figure 20B:
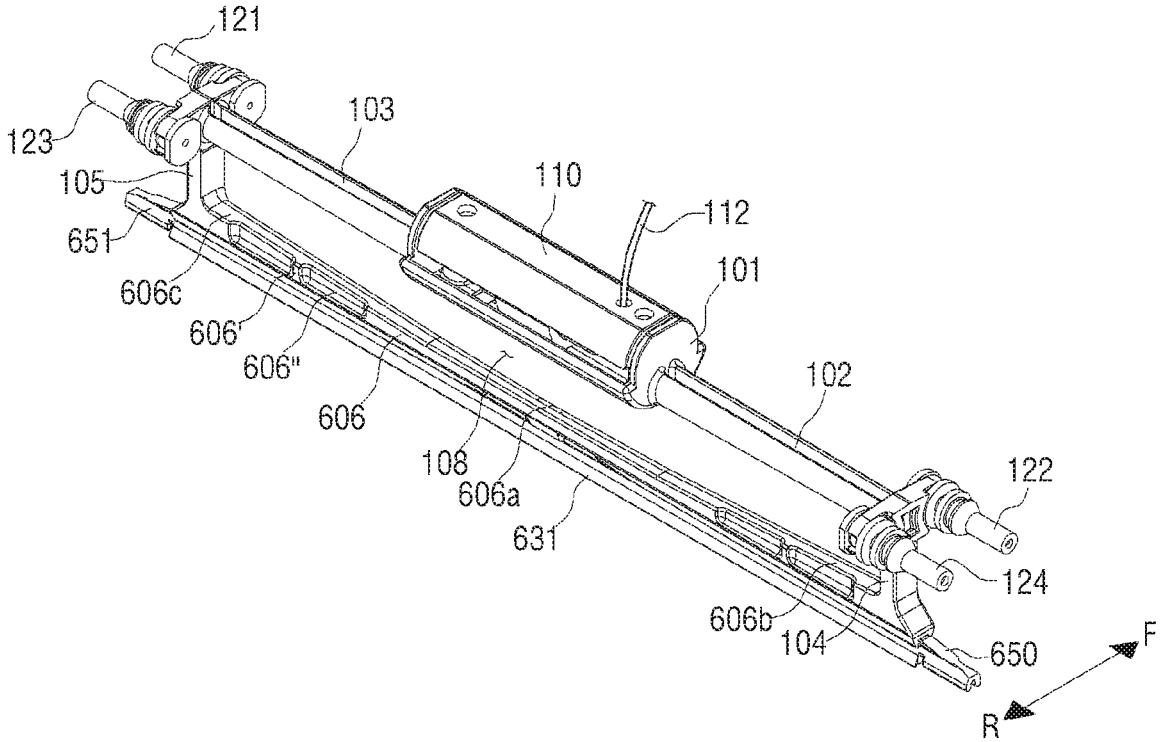
Figure 21:
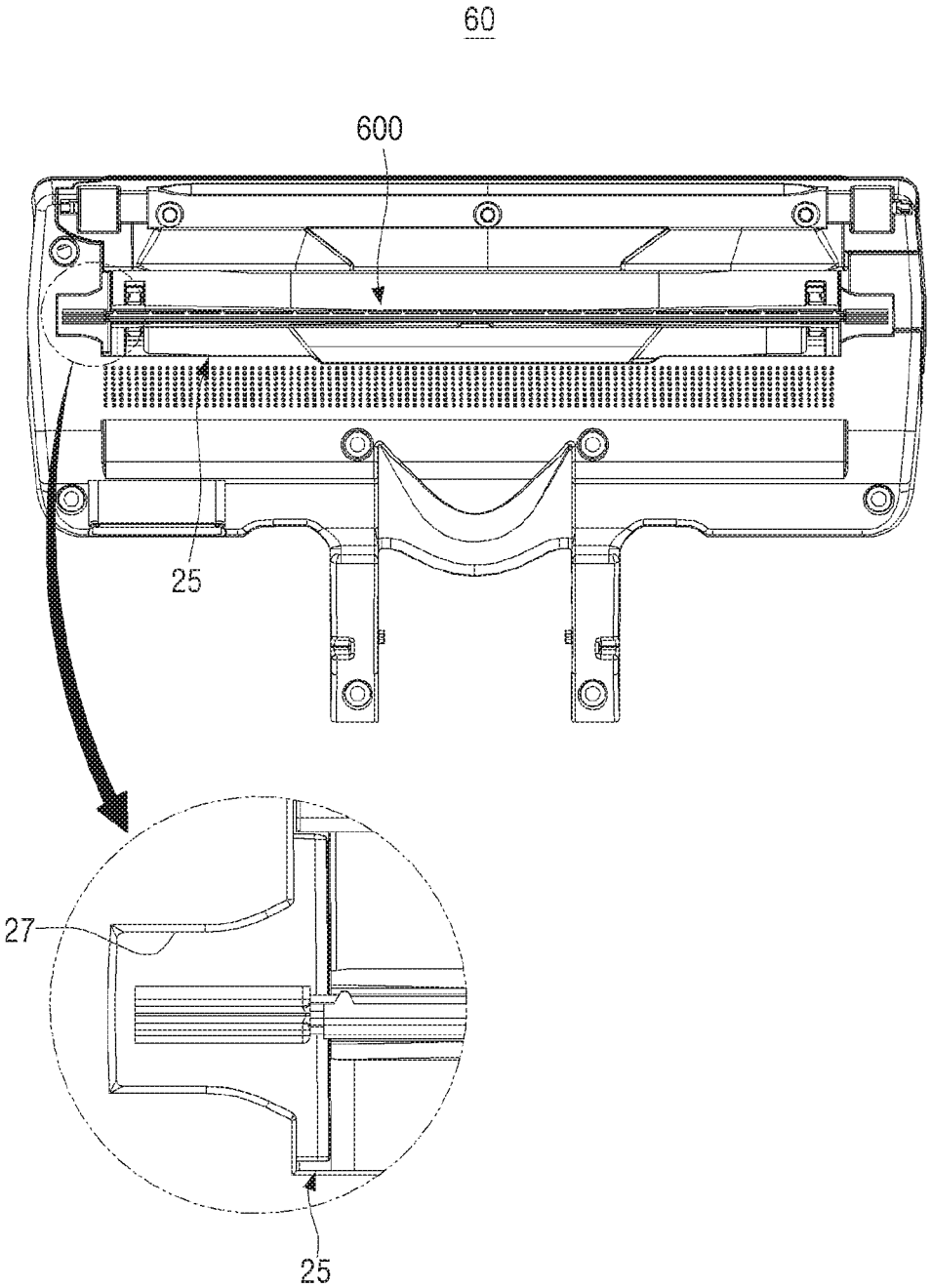
FIG. 21 is a view of a suction nozzle having a vibration cleaning unit mounted thereon as seen from a bottom according to an embodiment of the present disclosure.

Referring to FIGS. 20A to 21, the configuration of a vibration cleaning unit 600 according to an embodiment of the present disclosure will be described in detail.

Because the vibration cleaning unit 600 according to an embodiment of the present disclosure is different from the vibration cleaning unit 100 according to an embodiment of the present disclosure only on the point of the configuration of a vibration bar, explanation will be made with respect to the configuration of the vibration bar only, but explanation of the same configurations will be omitted.

FIGS. 20A and 20B are perspective views of a vibration cleaning unit as seen from various angles according to an embodiment of the present disclosure, and FIG. 21 is a view of a suction nozzle having a vibration cleaning unit mounted thereon as seen from a bottom according to an embodiment of the present disclosure.

Referring to FIGS. 20A to 21, a vibration bar 606, having a center portion 606*a* and end portions 606*b* and 606*c*, according to an embodiment of the present disclosure may include a pair of rubber blades 630 coupled to a groove (not illustrated) that is formed at a lower end thereof, an auxiliary blade 631 that projects downward farther than the pair of rubber blades 630, and at least one extension blade 650 and 651 additionally extending along the length direction of a suction port 25 from both ends of the pair of rubber blades 630. Further, on a suction nozzle 60, at least one extension groove 27 for accommodating the extension blades 650 and 651 is formed.

The extension groove 27 is connected to both side ends of the suction port 25 to communicate with the suction port 25. Accordingly, pollutants and dust that flow into the extension groove 27 may move to the suction port 25.

On the vibration bar 606 of the vibration cleaning unit 600 according to this embodiment, a groove 606" is formed. The groove 606", which is formed for a predetermined distance in the length direction of the vibration bar 606 on a surface on which the vibration bar 606 is directed to the rear (R), is formed by cutting a part of the rear surface of the vibration bar 606.

Further, on one side of the groove 606", a convex portion 606' is formed.

The pair of rubber blades 630 is integrally formed, and may be configured to be fitted into a groove (not illustrated) formed at a lower end of the vibration bar 606. Further, the auxiliary blade 631 may also be integrally formed with the pair of rubber blades 630.

Further, because the extension blades 650 and 651 and the extension groove 27 are formed, the vibration cleaning unit 600 can approach even a cornered region that the vibration cleaning unit 100 according to an embodiment of the present disclosure cannot approach. Accordingly, the vibration cleaning unit 600 has a wide cleaning range.

The extension blades 650 and 651 are integrally formed with the pair of rubber blades 630, and are made of the same material as the material of the rubber blades.

The auxiliary blade 631 may not be coupled to the extension blades 650 and 651 so that the extension blades 650 and 651 vibrate smoothly on a cornered surface to be cleaned.

Further, on one surface of the blade that is directed to the forefront between the pair of rubber blades 630, a plurality of projections 640 arranged at intervals along a lower portion may be further formed.

The projections 640 may be formed to project toward the front (F) of the suction nozzle 60.

The plurality of projections 640 prevent hair from being tangled on the rubber blades 630, the groove (not illustrated) formed at the lower end of the vibration bar, the vibration transfer frames 102 and 103, the accommodation groove 101, the connection members 104 and 105, and the vibration bar 606.

Because the vibration cleaning unit 600 further includes the plurality of projections 640 and the extension blades 650 and 651, it has high cleaning efficiency with respect to the surface to be cleaned and has a wide cleaning range.

Figure 22A:
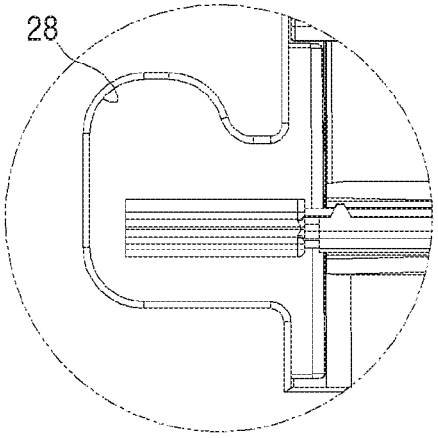
FIGS. 22A, 22B, and 22C are views illustrating various shapes of an extension groove formed on a suction nozzle according to an embodiment of the present disclosure.
Figure 22B:
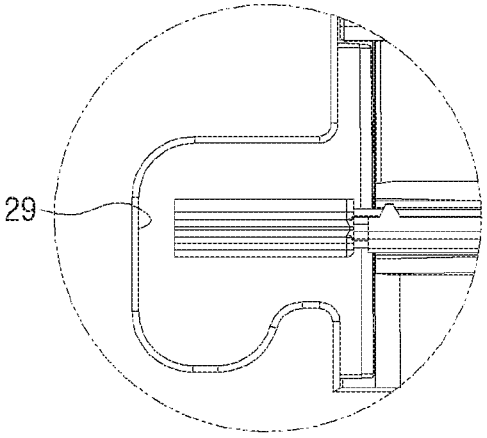
Figure 22C:
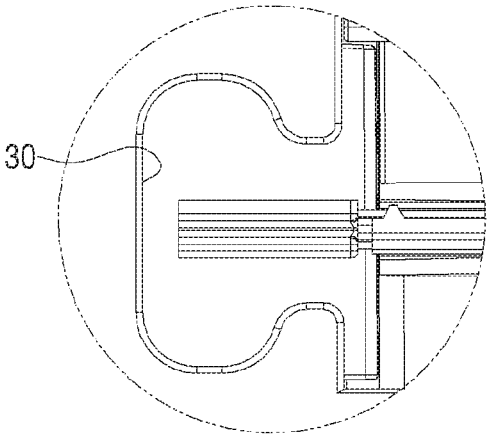

Referring to FIGS. 22A to 22C, an extension groove having various shapes according to an embodiment of the present disclosure will be described.

The extension groove having various shapes according to an embodiment of the present disclosure is different from the extension groove 26 formed on the suction nozzles 30 and 60 according to an embodiment of the present disclosure only on the point of the shape of the extension groove, explanation will be made with respect to the shape of the extension groove only, but explanation of the same configurations will be omitted.

FIGS. 22A to 22C are views illustrating various shapes of an extension groove formed on a suction nozzle according to an embodiment of the present disclosure.

The extension groove may have various shapes in order to increase the cleaning range of a suction nozzle including a vibration cleaning unit having an extension portion. Accordingly, the shapes of the extension grooves are not limited to those of extension grooves 28, 29, and 30 as illustrated in FIGS. 22A to 22C, but various embodiments may exist.

Referring to FIG. 22A, a longer extension groove 28 may be formed toward the rear (R) so that the cleaning range is increased with respect to the rear (R) of the suction nozzles 30 and 60. Further, referring to FIG. 22B, a longer extension groove 29 may be formed toward the front (F) so that the cleaning range is increased with respect to the front (F) of the suction nozzles 30 and 60.

Further, referring to FIG. 22C, a longer extension groove 30 may be formed toward both the front and the rear so that the cleaning range is increased with respect to the front (F) and the rear (R) of the suction nozzles 30 and 60.

Referring to FIGS. 23 and 24A to 24D, an extension suction port that is formed on a suction nozzle according to an embodiment of the present disclosure will be described.

Because the extension suction port that is formed on the suction nozzle according to an embodiment of the present disclosure is different from the suction nozzle according to an embodiment of the present disclosure only on the point of the configuration of the extension suction port, explanation will be made with respect to the configuration of the extension suction port only, but explanation of the same configurations will be omitted.

Figure 23:
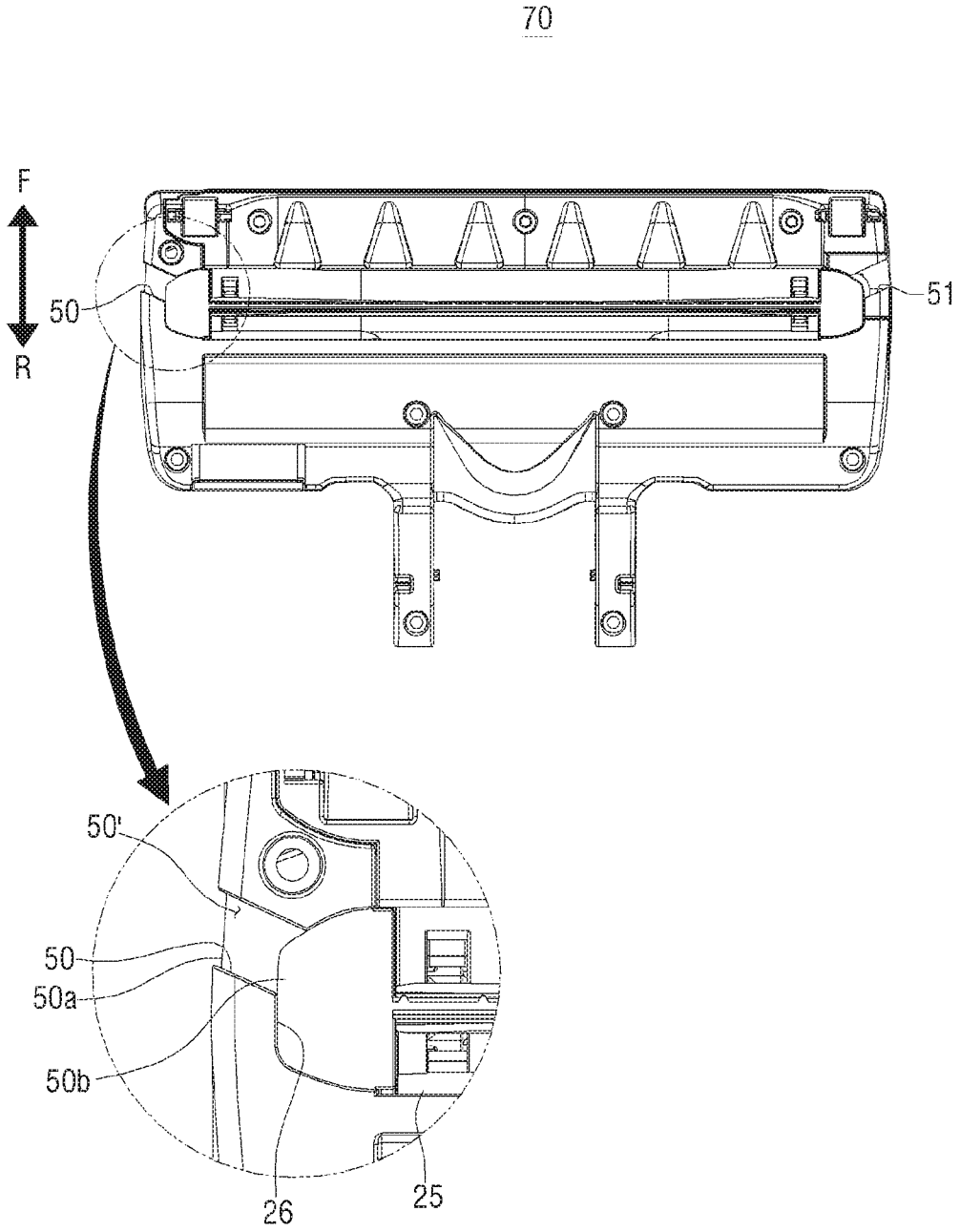
FIG. 23 is a view of a suction nozzle having an extension suction port formed thereon as seen from a bottom according to an embodiment of the present disclosure.

FIG. 23 is a view illustrating a bottom surface of a suction nozzle having an extension suction port formed thereon according to an embodiment of the present disclosure, and FIGS. 24A to 24D are views illustrating various shapes of an extension suction port.

On a suction nozzle 70 according to an embodiment of the present disclosure, at least one extension suction port 50 and 51 is formed.

The extension suction port 50 has one end 50*b* connected to an outside of the extension groove 26 and the other end 50*a* that is open toward an outside of the housing.

Because the extension suction port 50 communicates with the extension groove 26, it forms an additional suction flow path 50' that is connected to the suction port 25 by the extension suction port 50.

Pollutants and dust may flow into the additional suction flow path 50' and my move up to the suction port 25. Accordingly, a vacuum cleaner and a robot cleaner having the suction nozzle 70 according to this embodiment have a cleaning range that extends up to a cornered surface to be cleaned which even the extension groove 26 cannot approach.

The extension suction port 50 may be formed to have a predetermined angle with the suction port 25 and a vibration bar 706. That is, the other end 50*a* of the extension suction port may be formed to be further inclined toward the front (F) of the suction nozzle than one end 50*b* thereof.

This is to make the extension suction port 50 easily approach a cornered surface to be cleaned where walls join together so as to easily suck the dust and pollutants existing on the cornered surface to be cleaned through the suction port 25 of the suction nozzle.

However, it is not limited that the extension suction port 50 is formed on a parallel line to the suction port 25.

Further, one end 50*b* and the other end 50*a* of the extension suction port may be connected by a straight line, but are not limited thereto. The ends of the extension suction port may be connected in various shapes.

Figure 24A:
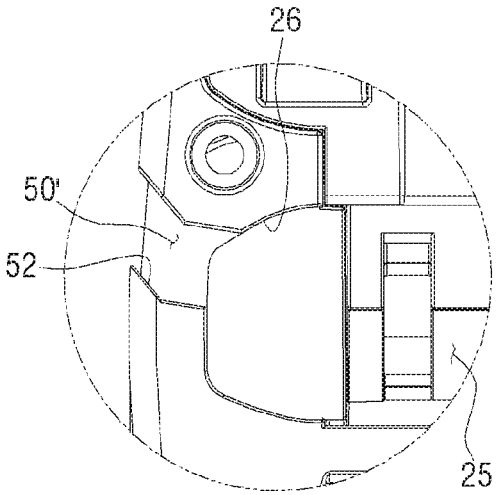
FIGS. 24A, 24B, 24C, and 24D are views illustrating various shapes of an extension suction port formed on a suction nozzle according to an embodiment of the present disclosure.
Figure 24B:
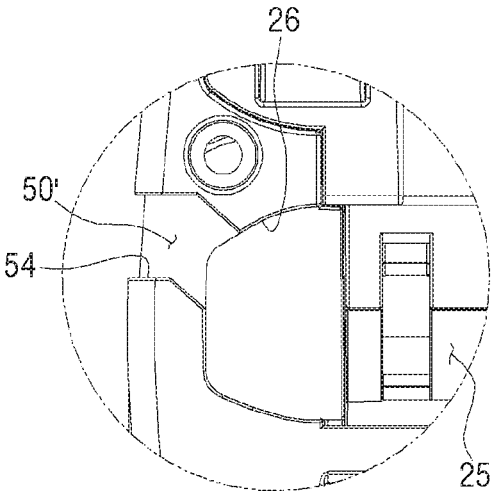

As illustrated in FIGS. 24A and 24B, one end 50*b* and the other end 50*a* of the extension suction port may be connected by straight lines 52 and 54 that are bent at a predetermined angle in a predetermined portion.

Figure 24C:
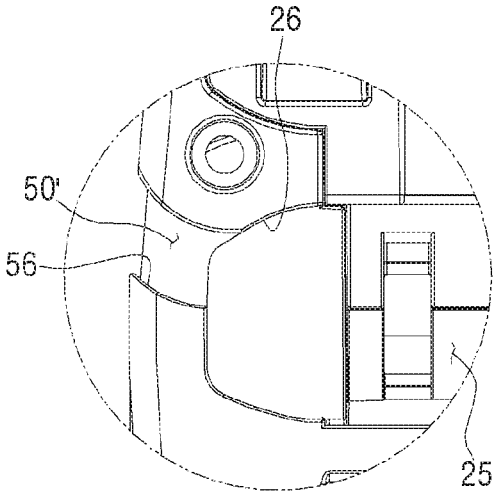
Figure 24D:
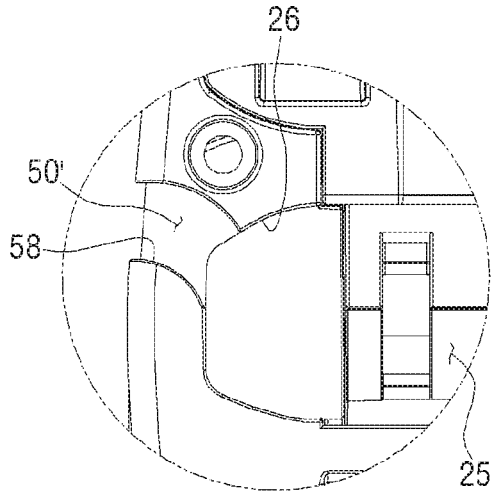

Further, as illustrated in FIGS. 24C and 24D, one end 50*b* and the other end 50*a* of the extension suction port may be connected by curves 56 and 58 having a predetermined curvature.

However, even in any case, the other end 50*a* of the extension suction port may be formed to be further inclined toward the front (F) of the suction nozzle than one end 50*b* of the extension suction port.

The shape of the extension suction port 50 may be variously changed in accordance with the vibration cleaning unit 700 according to an embodiment of the present disclosure to be described later.

Because the additional suction flow path 50' is formed between the cornered surface to be cleaned and the suction port 25, the suction nozzle 70 on which the extension suction port 50 is formed can directly suck the pollutants from the cornered surface to be cleaned.

Figure 25A:
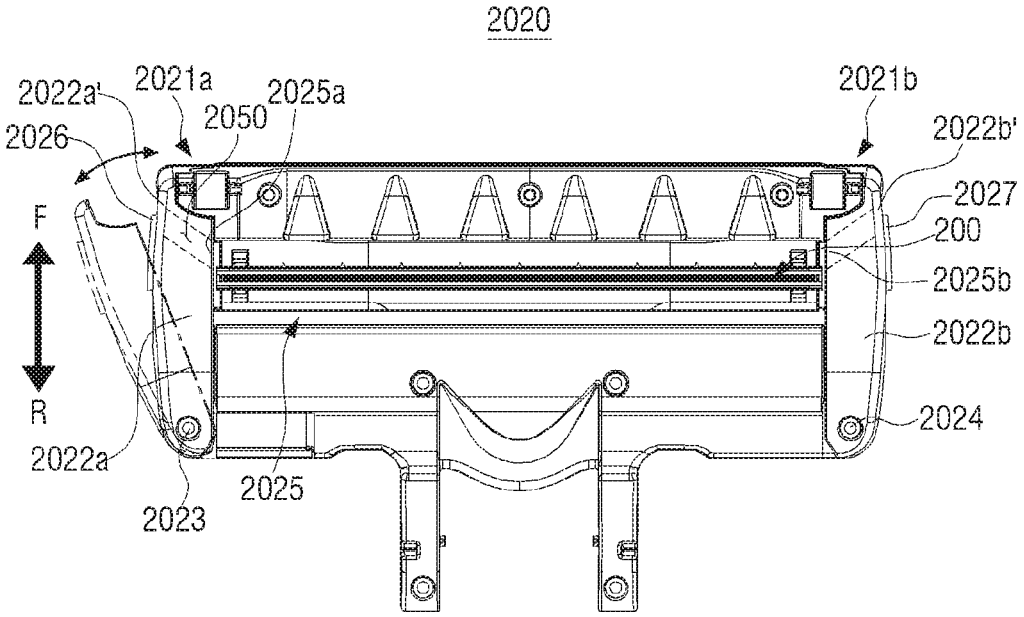
FIGS. 25A and 25B are views of a suction nozzle as seen from a bottom according to an embodiment of the present disclosure.
Figure 25B:
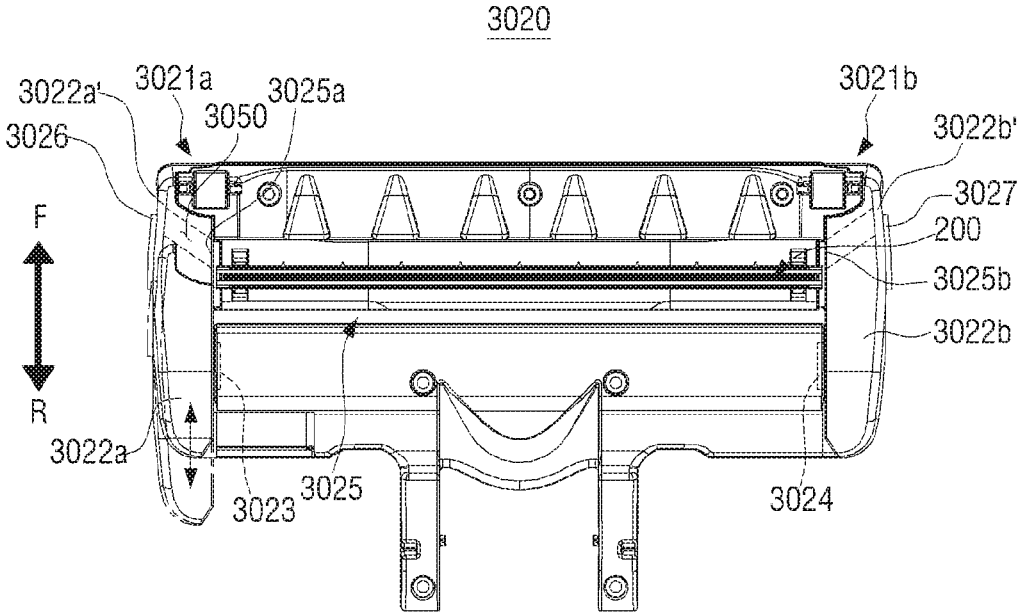

Referring to FIGS. 25A and 25B, the configuration of a suction nozzle according to an embodiment of the present disclosure will be described in detail.

FIGS. 25A and 25B are views of a suction nozzle as seen from a bottom according to an embodiment of the present disclosure.

A suction nozzle 2020 according to an embodiment of the present disclosure includes at least one variable portion 2022*a* and 2022*b* provided at both ends 2021*a* and 2021*b* thereof.

The variable portions 2022*a* and 2022*b* are movable from a first position to a second position to open one end of a suction port 2025.

The first position refers to a position in which the variable portions 2022*a* and 2022*b* can close the one end of the suction port 2025, and the second position refers to a position in which the variable portions 2022*a* and 2022*b* can open the one end of the suction port 2025.

The variable portions 2022*a* and 2022*b* are mounted at both ends 2021*a* and 2021*b* of the suction nozzle to be rotatable around at least one hinge element 2023 and 2024.

The hinge elements 2023 and 2024 further include an elastic member (not illustrated) that can return the variable portions 2022*a* and 2022*b* from the second position to the first position.

The elastic member may be a torsion spring. However, any spring can be used so far as it can return the variable portions 2022*a* and 2022*b* from the second position to the first position.

On outer sides 2022*a'* and 2022*b'* of the variable portions, at least one friction member 2026 and 2027 is mounted. The friction members 2026 and 2027 come in contact with wall surfaces positioned around a surface to be cleaned.

Hereinafter, the operations of a suction nozzle 2020 and variable portions 2022*a* and 2022*b* according to an embodiment of the present disclosure will be described.

As the suction nozzle 2020 proceeds to the front (F) or the rear (R), any one 2021*a* of both ends 2021*a* and 2021*b* of the suction nozzle becomes closer to a wall.

In this case, if the suction nozzle 2020 proceeds to the front (F), the friction member 2026 that is mounted on the outside 2022*a*' of the variable portion causes friction with the wall to generate frictional resistance to the rear (R).

The variable portion 2022*a* formed at one end 2021*a* of the suction nozzle is rotated toward the second position around the hinge element 2023 by the frictional resistance that the friction member 2026 generates to the rear (R) of the suction nozzle. In this case, the second position refers to an outside of the suction nozzle 2020.

In this case, as a suction flow path 2050 that is clogged by the variable portion 2022*a* is opened, one end 2025 of the suction port and the suction flow path 2050 communicate with each other.

The suction flow path 2050 connects an outside of the suction nozzle 2020 and one end 2025*a* (or 2025*b*) of the suction port to each other, and makes the suction port 2025 open to the outside of the suction nozzle. Further, through this suction flow path 2050, dust and pollutants flow in.

Thereafter, if the suction nozzle 2020 proceeds to the rear (R), the friction member generates frictional resistance toward the front (F), and the variable portion 2022*a* is rotated toward the first position around the hinge element 2023. In this case, the first position refers to one end 2021*a* where the variable portion 2022*a* is mounted on the suction nozzle 2020.

If the variable portion 2022*a* moves to the first position, one end 2025*a* of the suction port is closed again, and the suction flow path 2050 is also closed.

If the suction nozzle 2020 separates from the wall, the variable portion 2022*a* returns to the first position by an elastic member (not illustrated) that is installed around the hinge element 2023.

In this embodiment, although a separate extension suction port is not formed on the suction nozzle 2020, the suction nozzle can clean a cornered surface to be cleaned on which walls join together as the variable portions 2022*a* and 2022*b* moves between the first and second positions, and a vacuum cleaner having the suction nozzle 2020 has an extended cleaning range.

On the suction nozzle 2020 according to an embodiment of the present disclosure, the vibration cleaning unit according to various embodiments of the present disclosure may be mounted inside the suction port 2025. Because the vibration cleaning unit has the same configuration as the configuration of the vibration cleaning unit as described above, explanation thereof will be omitted.

A suction nozzle 3020 according to an embodiment of the present disclosure includes at least one variable portion 3022*a* and 3022*b* provided at both ends 3021*a* and 3021*b* thereof.

The variable portions 3022*a* and 3022*b* are coupled to both ends 3021*a* and 3021*b* of the suction nozzle 3020 to be slidable to the front (F) and the rear (R), and may linearly move between the first and second positions.

The first position refers to a position in which the variable portions 3022*a* and 3022*b* can close one end of the suction port 3025, and the second position refers to a position in which the variable portions 3022*a* and 3022*b* can open the one end of the suction port 3025.

Further, the suction nozzle 3020 further includes elastic members 3023 and 3024 that can return the variable portions 3022*a* and 3022*b* from the second position to the first position.

The elastic member may be a coil or pin spring. However, any spring can be used so far as it can return the variable portions 3022*a* and 3022*b* from the second position to the first position.

On outer sides 3022*a*' and 3022*b*' of the variable portions, at least one friction member 3026 and 3027 is mounted. The friction members 3026 and 3027 come in contact with wall surfaces positioned around a surface to be cleaned.

Hereinafter, the operations of a suction nozzle 320 and variable portions 3022*a* and 3022*b* according to an embodiment of the present disclosure will be described.

As the suction nozzle 3020 proceeds to the front (F) or the rear (R), any one of both ends 3021*a* and 3021*b* of the suction nozzle comes in contact with a wall.

In this case, if the suction nozzle 3020 proceeds to the front (F), the friction member 3026 that is mounted on the outside 3022*a*' of the variable portion causes friction with the wall to generate frictional resistance to the rear (R).

The variable portion 3022*a* formed at one end 3021*a* of the suction nozzle linearly moves to the second position by the frictional resistance that the friction member 3026 generates to the rear (R) of the suction nozzle. The second position refers to a position in which the variable portion moves to slide to the rear (R) of the suction nozzle 3020.

In this case, as a suction flow path 3050 that is clogged by the variable portion 3022*a* is opened, one end 3025*a* of the suction port and the suction flow path 3050 communicate with each other.

The suction flow path 3050 connects an outside of the suction nozzle and one end 3025*a* (or 3025*b*) of the suction port to each other, and makes the suction port 3025 open to the outside of the suction nozzle. Further, through this suction flow path 3050, dust and pollutants flow in.

Thereafter, if the suction nozzle 3020 proceeds to the rear (R), the friction member generates frictional resistance toward the front (F), and the variable portion 3022*a* linearly moves to the first position. The first position refers to one end 3021*a* where the variable portion 3022*a* is mounted on the suction nozzle 3020, and the variable portion 3022*a* moves to slide to the front (F) when it moves to the first position.

Through this, one end 3025*a* of the suction port is closed again, and the suction flow path 3050 is also closed.

If the suction nozzle 3020 separates from the wall, the sliding variable portion 3022*a* returns to the first position by an elastic member 3023.

In this embodiment, although a separate extension suction port is not formed on the suction nozzle 3020, the suction nozzle can clean a cornered surface to be cleaned on which walls join together as the variable portions 3022*a* and 3022*b* moves between the first and second positions, and a vacuum cleaner having the suction nozzle 3020 has an extended cleaning range.

On the suction nozzle 3020 according to an embodiment of the present disclosure, the vibration cleaning unit according to various embodiments of the present disclosure may be mounted inside the suction port 3025. Because the vibration cleaning unit has the same configuration as the configuration of the vibration cleaning unit as described above, explanation thereof will be omitted.

Figure 26:
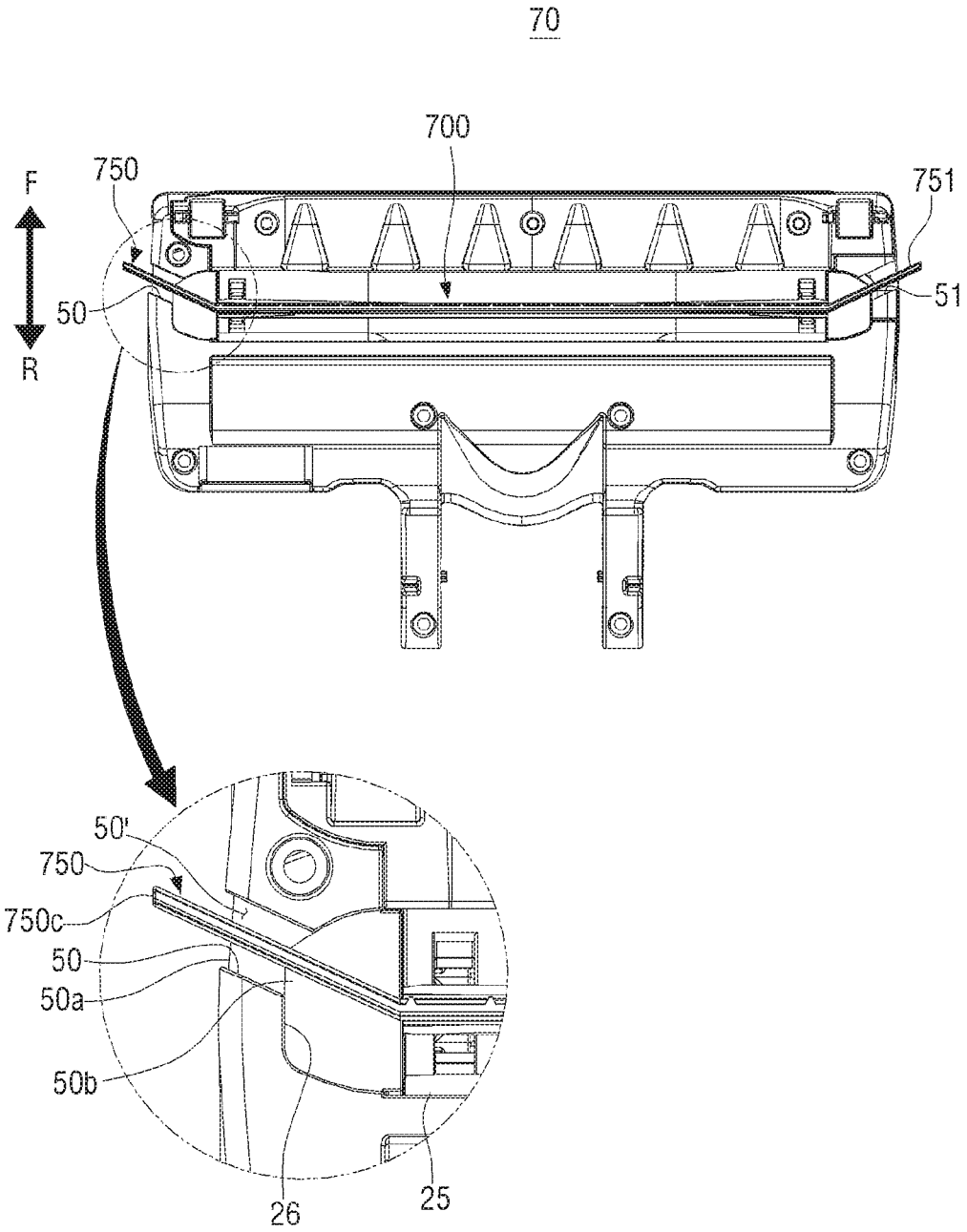
FIG. 26 is a view of a suction nozzle having a vibration cleaning unit mounted thereon as seen from a bottom according to an embodiment of the present disclosure.
Figure 27A:
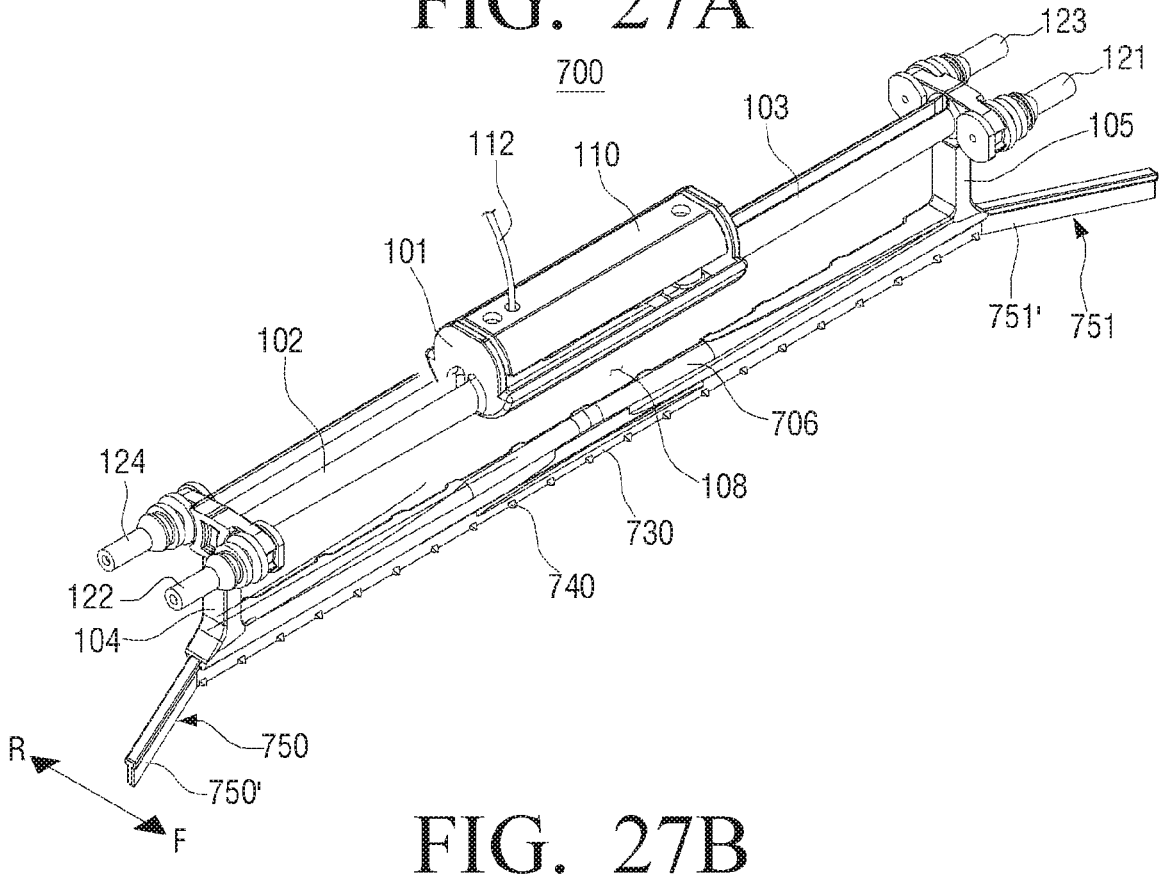
FIGS. 27A and 27B are perspective views of a vibration cleaning unit as seen from various angles according to an embodiment of the present disclosure.
Figure 27B:
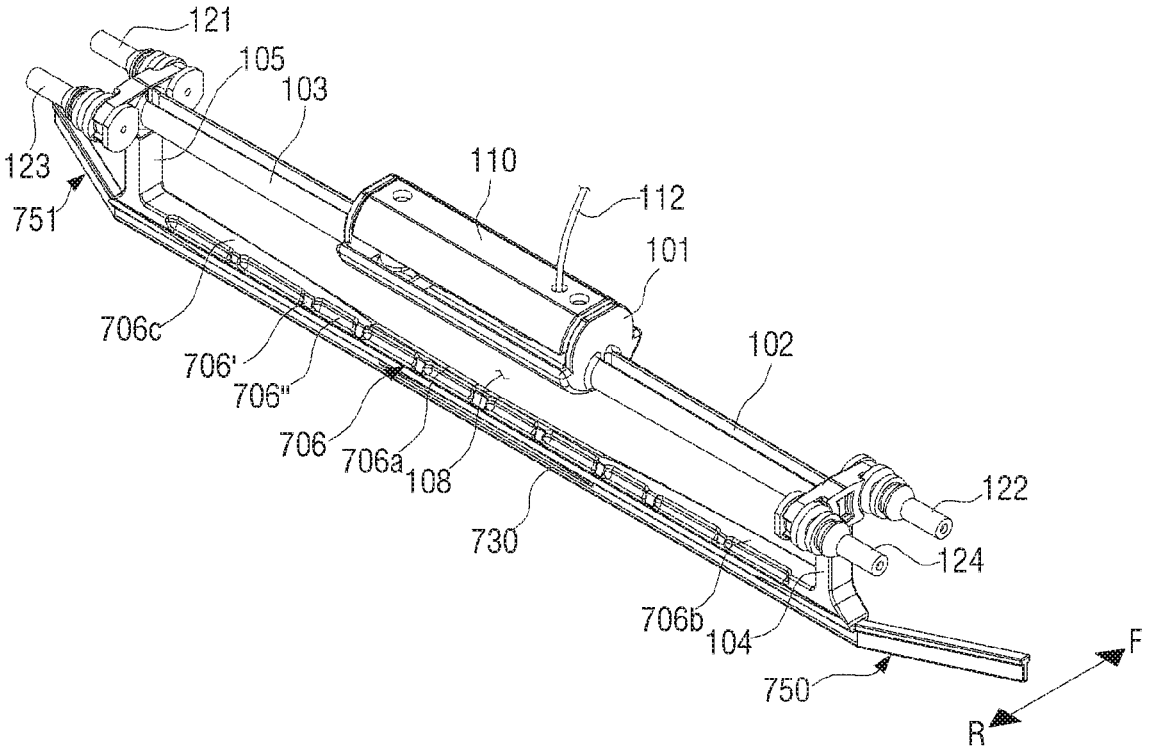
Figure 28:
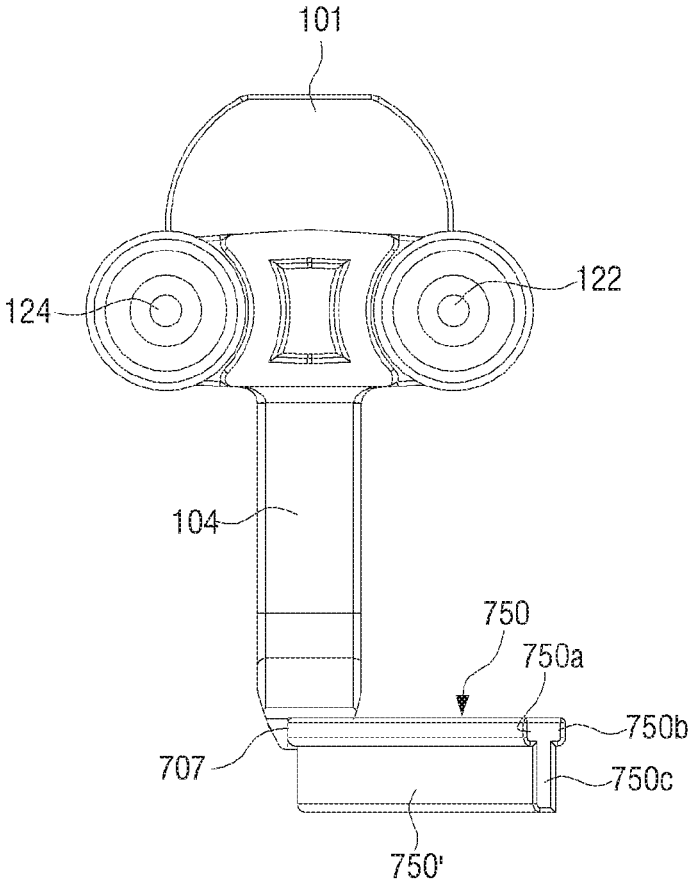
FIG. 28 is a side view of a vibration cleaning unit according to an embodiment of the present disclosure.

Referring to FIGS. 26 to 28, the configuration of a vibration cleaning unit 700 according to an embodiment of the present disclosure will be described in detail.

Because the vibration cleaning unit 700 according to an embodiment of the present disclosure is different from the vibration cleaning unit 100 according to an embodiment of the present disclosure only on the point of the configuration of a vibration bar, explanation will be made with respect to the configuration of the vibration bar only, but explanation of the same configurations will be omitted.

FIG. 26 is a view of a suction nozzle having a vibration cleaning unit mounted thereon as seen from a bottom according to an embodiment of the present disclosure, and FIGS. 27A and 27B are perspective views of a vibration cleaning unit as seen from various angles according to an embodiment of the present disclosure. FIG. 28 is a side view of a vibration cleaning unit according to an embodiment of the present disclosure.

The vibration cleaning unit 700 according to this embodiment may include at least one rubber blade 730 that is coupled along a lower end of a vibration bar 706, but a brush (not illustrated) may be mounted instead of the rubber blade 730.

Because the rubber blade 730 has higher elasticity than that of the skirts 130 and 131 according to an embodiment of the present disclosure, it can minimize damage of a surface to be cleaned.

Further, because the rubber blade 730 has higher adsorption force with respect to dust or pollutants than the adsorption force of the skirts 130 and 131 according to an embodiment of the present disclosure, the cleaning efficiency is also heightened.

The rubber blade 730 may be mounted both in the front (F) and the rear (R) of the vibration cleaning unit, but in this embodiment, it is exemplified that only one rubber blade 730 is mounted at a lower end of the vibration bar 706.

Further, a plurality of projections 740 may be arranged at constant intervals along a lower portion of one surface of the rubber blade 730.

The projections 740 are formed on a front surface of a lower portion of the rubber blade 730, and are formed to project toward the front (F) of the suction nozzle 20.

By the projections 740, hair existing on a surface to be cleaned is separated into hair strands to be sucked into the suction nozzle 20. Further, pollutants having large volume and heavy weight can be sucked into a center portion 706*a* of the vibration bar by the projections 740.

The vibration bar 706 according to this embodiment is formed so that the center portion 706*a* is closer to the surface to be cleaned than both ends 706*b* and 706*c* of the vibration bar on the basis of the surface to be cleaned. Accordingly, the center portion 706*a* of the vibration bar makes the pollutants having large volume and heavy weight easily go over the rubber blade 730 and the vibration bar 706 to be sucked into a pollutant inflow space 108.

At both ends of the rubber blade 730, wing portions 750 and 751 are formed to extend.

If the rubber blade 730 vibrates as the vibration bar 706 resonates, the wing portions 750 and 751 resonate by the vibration of the rubber blade 730. Accordingly, the wing portions 750 and 751 may be integrally formed with the rubber blade 730. However, it is not excluded that the wing portions 750 and 751 are configured separately from the rubber blade 730.

A part of the wing portions 750 and 751 is accommodated in an extension suction port 50, and the remainder thereof projects to an outside of a housing of the suction nozzle 70. In particular, the other end 750*c* of the wing portion that projects to the outside of the housing 22 of the suction nozzle comes in contact with a cornered surface to be cleaned where walls join together to sweep the surface to be cleaned.

Accordingly, the pollutants existing on the cornered surface to be cleaned move to the front (F) of the suction nozzle 70 or flow into the extension suction port 50.

The wing portions 750 and 751 may be slantingly arranged toward the front (F) of the suction nozzle so that they have a constant angle with the vibration bar 706 and the rubber blade 730. Such an arrangement prevents the swept pollutants from being dispersed to the rear (R) of the suction nozzle.

The wing portion 750 may be formed to have a T-shaped cross section. In this case, on an upper portion of the wing portion 750, at least two sliding portions 750*a* and 750*b*, which are horizontal to the surface to be cleaned and which project to the front (F) and the rear (R) of the suction nozzle, are formed.

Further, on the upper portion of the wing portion 750, a wing blade 750' is formed, which is vertical to the sliding portions 750*a* and 750*b* and the surface to be cleaned and which extends downward from the sliding portions 750*a* and 750*b*. Similarly, on the upper portion of the wing portion 751, a wing blade 751' is formed.

The sliding portions 750*a* and 750*b* prevent the dust or pollutants, which are generated when the wing portion 750 vibrates and the wing blade 750' strikes or sweeps the surface to be cleaned, from scattering in the vertical direction of the surface to be cleaned.

Further, if the wing portion 750 is integrally formed with the rubber blade 730, the rubber blade 730 and the wing portion 750 may be slidably coupled to a groove 707 formed at the lower end of the vibration bar by the sliding portions 750*a* and 750*b*.

Accordingly, because the rubber blade 730 and the wing portion 750 can be easily mounted in the groove 707 formed at the lower end of the vibration bar, the manufacturing process is simplified, and the manufacturing time is shortened. Further, if the rubber blade 730 and the wing portion 750 that come in contact with the surface to be cleaned are worn away due to their continuous vibration, a user can easily replace the rubber blade 730 and the wing portion 750.

The wing blade 750' that comes in contact with the surface to be cleaned sweeps the surface to be cleaned as it receives vibration that is transferred from the rubber blade 730 and vibrates in the front (F) and the rear (R).

On a surface where the vibration bar 706 is directed to the rear (R), a plurality of grooves 706" may be formed at predetermined intervals along the length direction of the vibration bar 706.

The grooves 706" are formed by cutting a part of the rear surface of the vibration bar 706, and a convex portion 706' is formed on both sides of the groove 706".

The grooves 706" serve to adjust the thickness of the vibration bar 706. If the grooves 706" are formed, the thickness of the vibration bar 706 generally becomes thin, and in particular, the thickness of the both ends 706*b* and 706*c* of the vibration bar is reduced.

In this case, the vibration frequency that is generated from the vibration motor 111 may be more greatly amplified at both ends 706*b* and 706*c* of the vibration bar 706, and the resonance effect becomes maximized by the amplified frequency.

Further, if the grooves 706" are formed during injection-molding of the vibration bar 706, a raw material for manufacturing the vibration bar 706 is reduced, and thus the manufacturing cost of the vibration cleaning unit 700 can be saved.

Because the vibration cleaning unit 700 according to this embodiment includes the wing portions 750 and 751 that vibrate due to the resonance phenomenon, the cleaning range for the cornered surface to be cleaned is further extended. Further, because the wing portions 750 and 751 vibrate due to the resonance phenomenon even without a separate driving source, the vibration cleaning unit 700 according to this embodiment can clean the cornered surface to be cleaned without any additional power consumption.

Further, if an extension portion that is formed to extend from the vibration bar 706 according to this embodiment is included, the wing portions 750 and 751 may additionally extend from the extension portion.

In this case, the wing portions further project to an outside of the housing of the suction nozzle 70 as compared with a case where the wing portions 750 and 751 are formed to extend from the rubber blade 730.

However, a part of the wing portions 750 and 751 is still accommodated in the extension suction port 50. Further, the extension portion is accommodated in the extension groove 26.

Figure 29A:
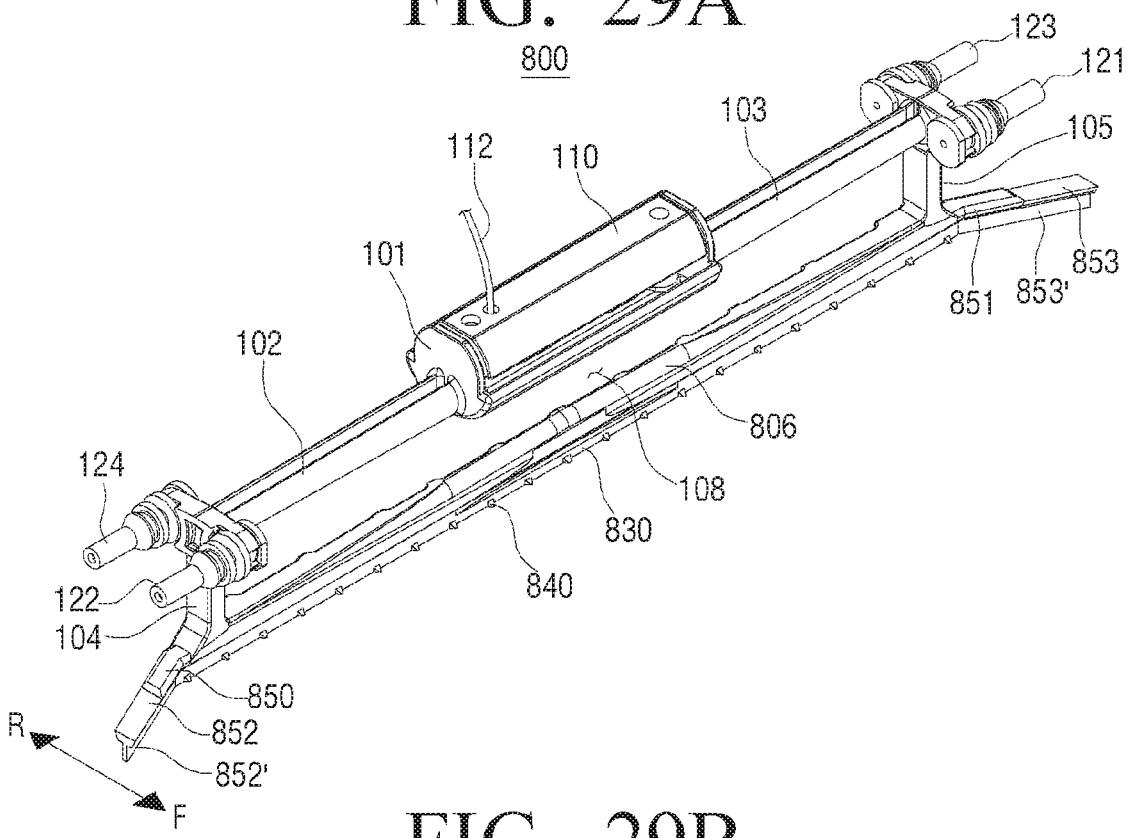
FIGS. 29A and 29B are perspective views of a vibration cleaning unit as seen from various angles according to an embodiment of the present disclosure.
Figure 29B:
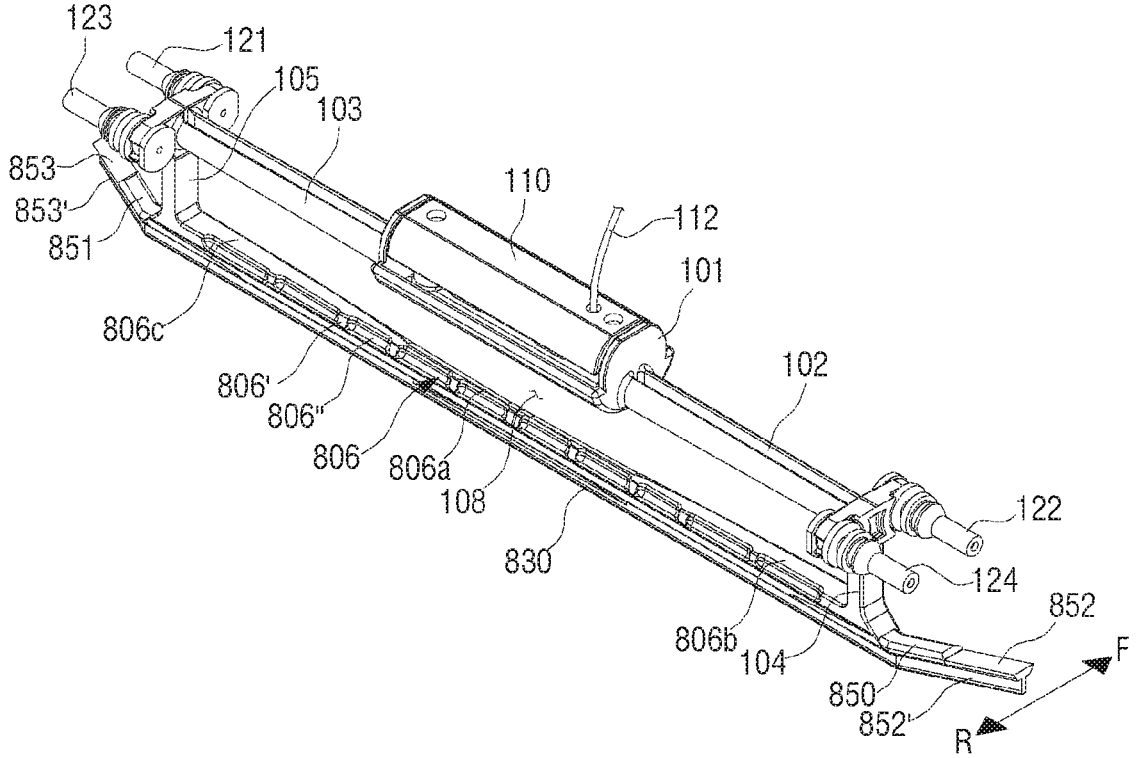
Figure 30:
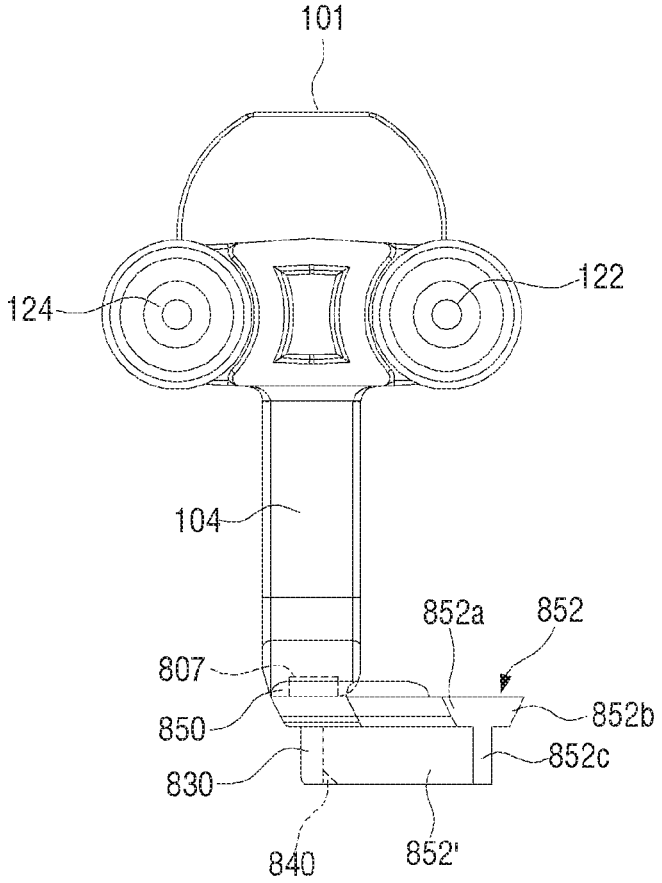
FIG. 30 is a side view of a vibration cleaning unit according to an embodiment of the present disclosure.

Referring to FIGS. 29A, 29B, and 30, the configuration of a vibration cleaning unit 800 according to an embodiment of the present disclosure will be described in detail.

Because the vibration cleaning unit 800 according to an embodiment of the present disclosure is different from the vibration cleaning unit 700 according to the an embodiment of the present disclosure only on the point of the configuration of a vibration bar and a wing portion, explanation will be made with respect to the configuration of the vibration bar and the wing portion only, but explanation of the same configurations will be omitted.

FIGS. 29A and 29B are perspective views of a vibration cleaning unit as seen from various angles according to an embodiment of the present disclosure, and FIG. 30 is a side view of a vibration cleaning unit according to an embodiment of the present disclosure.

A vibration bar 806 according to an embodiment of the present disclosure further includes at least one wing support 850 and 851 that is formed to extend from both ends 806*b* and 806*c* of the vibration bar along the length direction of a suction port 25, and at least one extension groove 26 for accommodating the wing supports 850 and 851 is formed on both sides of the suction port 25.

The wing supports 850 and 851 may be integrally formed with the vibration bar 806, and are formed of the same material. This is to enable the wing supports 850 and 851 to receive vibration that is transferred from the vibration bar 806 and to be transformed. However, it is not limited that the vibration bar 806 and the wing supports 850 and 851 are separately coupled or are made of different materials.

If the vibration bar 806 and the wing supports 850 and 851 are made of different materials, the wing supports 850 and 851 may be made of a material having higher elasticity than the elasticity of the material of the vibration bar 806.

The vibration cleaning unit 800 according to this embodiment may include at least one rubber blade 830 that is coupled along the lower end of the vibration bar 806, but it is not limited that a brush (not illustrated) is mounted instead of the rubber blade 830.

Further, a plurality of projections 840 may be arranged at constant intervals along a lower portion of one surface of the rubber blade 830.

Further, the vibration cleaning unit 800 further includes wing portions 852 and 853 that are additionally extend from the rubber blades 850 and 851.

If the rubber blade 830 vibrates as the vibration bar 806 resonates, the wing portions 852 and 853 resonate by the vibration of the rubber blade 830. Accordingly, the wing portions 852 and 853 may be integrally formed with the rubber blade 830. However, it is not excluded that the wing portions 852 and 853 are separately coupled to the rubber blade 830.

A part of the wing portions 852 and 853 is accommodated in an extension suction port 50, and the remainder thereof projects to an outside of a housing of the suction nozzle 70. In particular, the other end 852*c* of the wing portion that projects to the outside of the housing of the suction nozzle 70 comes in contact with a cornered surface to be cleaned where walls join together to sweep the surface to be cleaned.

Accordingly, the pollutants existing on the cornered surface to be cleaned move to the front (F) of the suction nozzle 70 or flow into the extension suction port 50.

Wing supports 850 and 851 support upper surfaces of the wing portions 852 and 853. The wing supports 850 and 851 support the wing portions 852 and 853 so that the wing portions 852 and 853 that are generally made of rubber having high elasticity strongly strike against the surface to be cleaned. Further, because the wing supports 850 and 851 vibrate by themselves, the wing portions 852 and 853 may vibrate more quickly and strongly.

The wing supports 850 and 851 and the wing portions 852 and 853 may be slantingly arranged toward the front (F) of the suction nozzle so that they have a constant angle with the vibration bar 806 and the rubber blade 830. Such an arrangement prevents the swept pollutants from being dispersed to the rear (R) of the suction nozzle.

The wing portion 852 may be formed to have a T-shaped cross section. In this case, on an upper portion of the wing portion 852, at least two sliding portions 852*a* and 852*b*, which are horizontal to the surface to be cleaned and which project to the front (F) and the rear (R) of the suction nozzle, are formed.

Further, on the upper portion of the wing portion 852, a wing blade 852' is formed, which is vertical to the sliding portions 852*a* and 852*b* and the surface to be cleaned and which extends to lower portions of the sliding portions 852*a* and 852*b*. Similarly, on the upper portion of the wing portion 853, a wing blade 853' is formed.

The sliding portions 852*a* and 852*b* according to this embodiment are wider than the sliding portions 750*a* and 750*b* according to an embodiment of the present disclosure, and project further to the front (F) and the rear (R) of the suction nozzle.

This is because a separate groove for coupling the wing portion 852 is not formed on the wing support 850, but an upper flat surface that is formed on the sliding portions 852*a* and 852*b* is configured to stick to a lower surface of the wing support 850. That is, it is not necessary that the width of the sliding portions 852*a* and 852*b* is smaller than the groove (not illustrated) that is formed at the lower end of the vibration bar 806, but the sliding portions may be formed rather wider than the groove (not illustrated).

Accordingly, the sliding portions 852*a* and 852*b* prevent the dust or pollutants, which are generated when the wing portion 852 vibrates and the wing blade 852' strikes or sweeps the surface to be cleaned, from scattering in the vertical direction of the surface to be cleaned.

The wing blade 852' sweeps the surface to be cleaned as it receives vibration that is transferred from the rubber blade 830, comes in contact with the surface to be cleaned, and vibrates in the front (F) and the rear (R).

If the wing portion 852 is integrally formed with the rubber blade 830, a part of the rubber blade 830 is slidably coupled to the groove (not illustrated) formed at the lower end of the vibration bar, and upper surfaces of the sliding portions 852*a* and 852*b* stick to the lower surface of the wing support 850 to be mounted thereon.

Accordingly, the rubber blade 830 and the wing portion 852 can be easily mounted onto the groove 807 formed at the lower end of the vibration bar, and in the case where the rubber blade 830 and the wing portion 852 are worn away, a user can easily replace the rubber blade 830 and the wing portion 852.

A plurality of convex portions 806' and grooves 806" are formed at constant intervals along the length direction of the vibration bar 806 on a surface of the vibration bar 806 that is directed to the rear (R), and the thickness of both ends 806*b* and 806*c* of the vibration bar becomes thinned by the grooves 806". Accordingly, the amplitude in accordance with the resonance can be maximized at the both ends 806*b* and 806*c* of the vibration bar.

Further, if the grooves 806" are formed when the vibration bar 806 is injection-molded, a raw material for manufacturing the vibration bar 806 is reduced, and thus the manufacturing cost of the vibration cleaning unit 800 can be saved.

The vibration bar 806 according to this embodiment is formed so that the center portion 806*a* is closer to the surface to be cleaned than both ends 806*b* and 806*c* of the vibration bar on the basis of the surface to be cleaned. Accordingly, the center portion 806*a* of the vibration bar makes the pollutants having large volume and heavy weight easily go over the rubber blade 830 and the vibration bar 806 to be sucked into a pollutant inflow space 108.

According to the vibration cleaning unit 800 according to this embodiment, the cleaning range for the cornered surface to be cleaned is greatly extended by the wing portions 852 and 853 that vibrate through the resonance phenomenon, and the cleaning efficiency for the cornered surface to be cleaned is heightened.

Further, because the wing supports 850 and 851 support the wing portions 852 and 853 so that the wing portions 852 and 853 can sweep the surface to be cleaned more quickly and strongly, the vibration cleaning unit 800 according to this embodiment has very high cleaning efficiency.

Because it is possible that the wing supports 850 and 851 and the wing portions 852 and 853 are made of a material having higher elasticity than that of the vibration bar 806, the vibration cleaning unit 800 according to this embodiment can clean the cornered surface to be cleaned without additional power consumption.

Figure 31A:
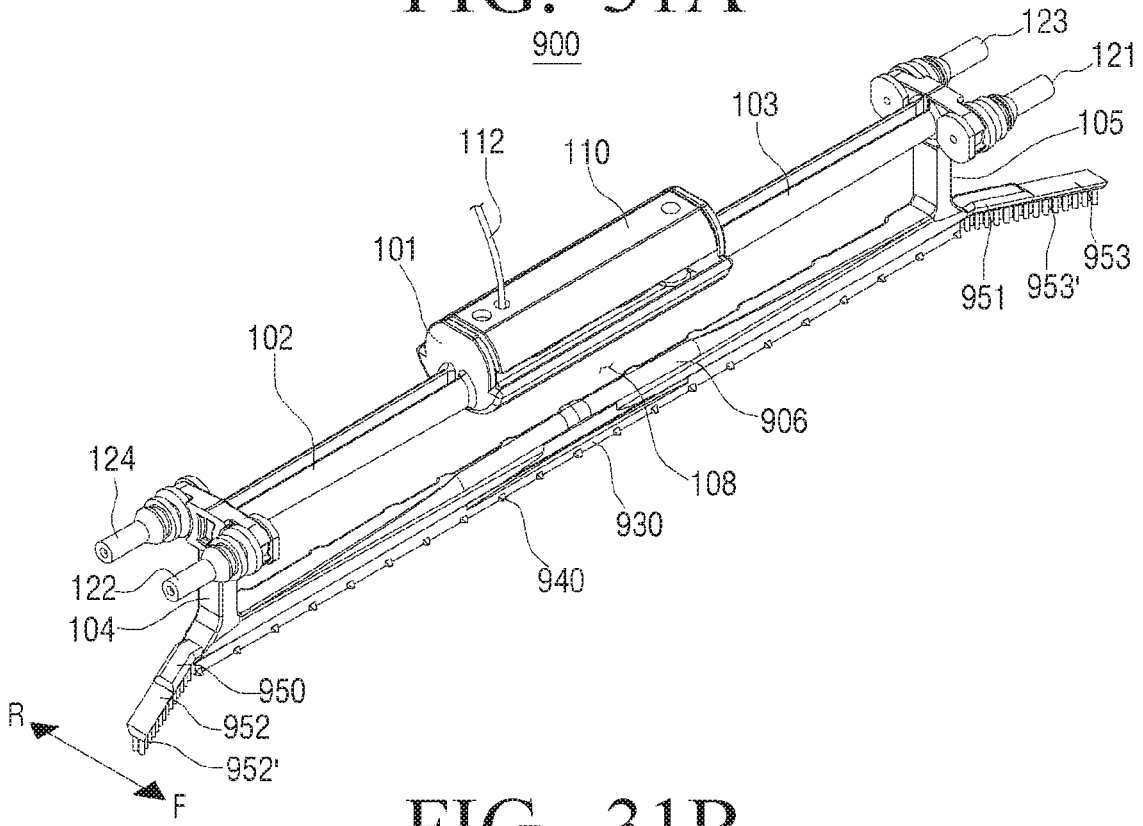
FIGS. 31A and 31B are perspective views of a vibration cleaning unit as seen from various angles according to an embodiment of the present disclosure.
Figure 31B:
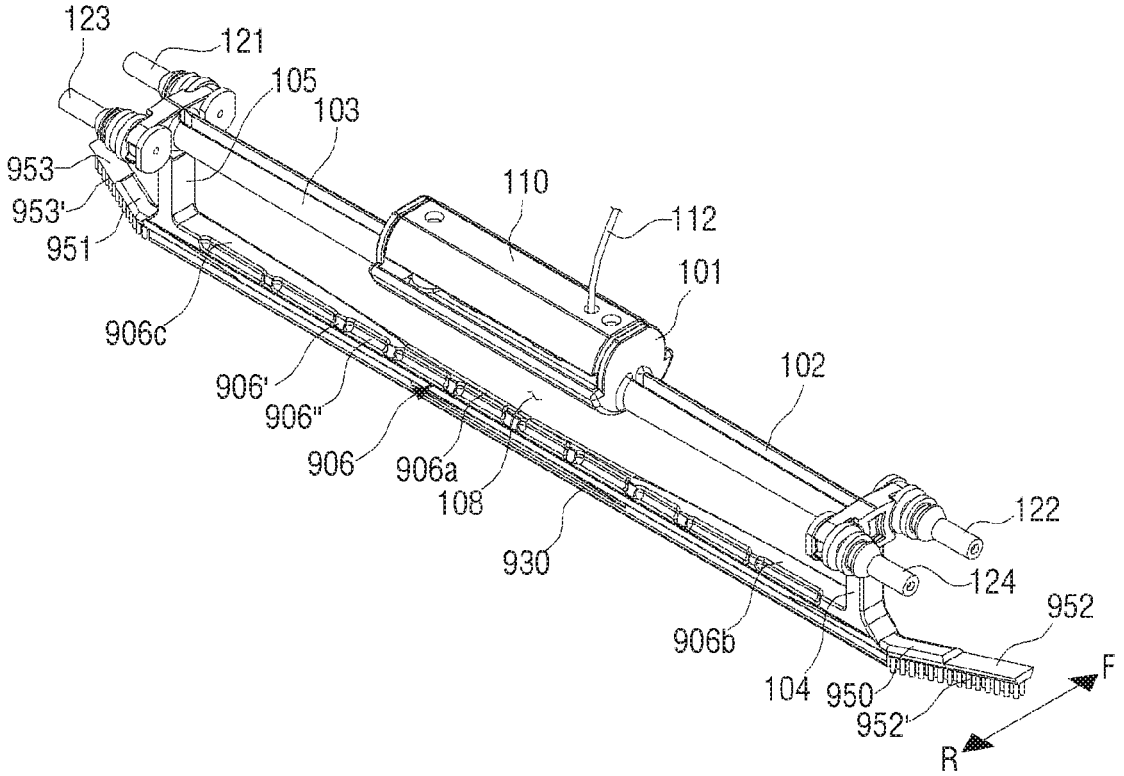
Figure 32:
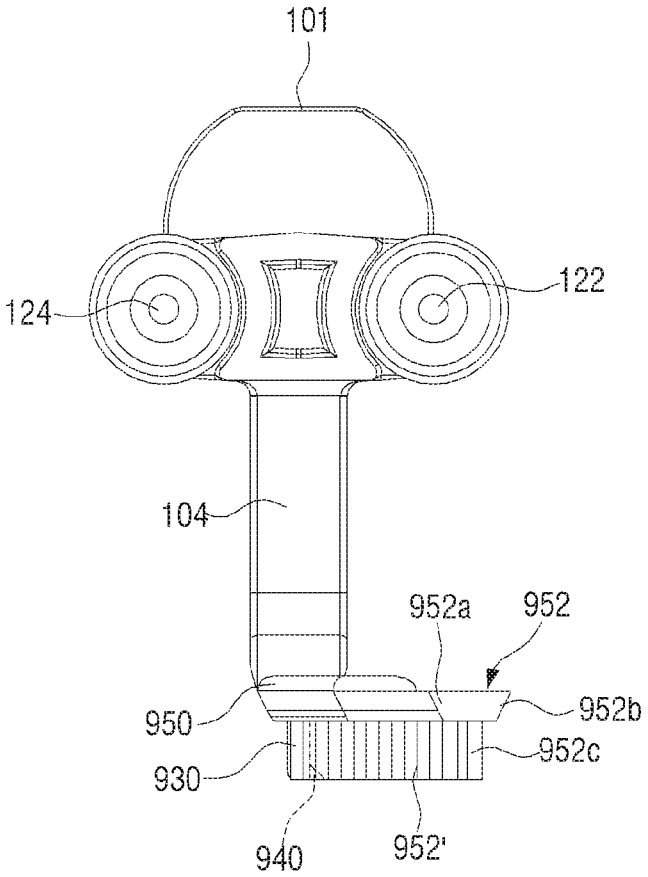
FIG. 32 is a side view of a vibration cleaning unit according to an embodiment of the present disclosure.

Referring to FIGS. 31A, 31B, and 32, the configuration of a vibration cleaning unit 900 according to an embodiment of the present disclosure will be described in detail.

Because the vibration cleaning unit 900 according to an embodiment of the present disclosure is different from the vibration cleaning unit 700 according to the an embodiment of the present disclosure only on the point of the configuration of a wing portion, explanation will be made with respect to the configuration of the wing portion only, but explanation of the same configurations will be omitted.

FIGS. 31A and 31B are perspective views of a vibration cleaning unit as seen from various angles according to an embodiment of the present disclosure, and FIG. 32 is a side view of a vibration cleaning unit according to an embodiment of the present disclosure.

A vibration bar 906 according to an embodiment of the present disclosure further includes at least one wing support 950 and 951 that is formed to extend from both ends 906*b* and 906*c* of the vibration bar along the length direction of a suction port 25, and at least one extension groove 26 for accommodating the wing supports 950 and 951 is formed on both sides of the suction port 25.

The wing supports 950 and 951 may be integrally formed with the vibration bar 906, and are formed of the same material. This is to enable the wing supports 950 and 951 to receive vibration that is transferred from the vibration bar 906 and to be transformed. However, it is not limited that the vibration bar 906 and the wing supports 950 and 951 are separately coupled or are made of different materials.

If the vibration bar 906 and the wing supports 950 and 951 are made of different materials, the wing supports 950 and 951 may be made of a material having higher elasticity than the elasticity of the material of the vibration bar 906.

The vibration cleaning unit 900 according to this embodiment may include at least one rubber blade 930 that is coupled along the lower end of the vibration bar 906, but it is not limited that a brush (not illustrated) is mounted instead of the rubber blade 930.

Further, a plurality of projections 940 may be arranged at constant intervals along a lower portion of one surface of the rubber blade 930.

Further, the vibration cleaning unit 900 further includes wing portions 952 and 953 that are additionally extend from the rubber blade 930.

If the rubber blade 930 vibrates as the vibration bar 906 resonates, the wing portions 952 and 953 resonate by the vibration of the rubber blade 930. Accordingly, the wing portions 952 and 953 may be integrally formed with the rubber blade 930. However, it is not excluded that the wing portions 952 and 953 are separately coupled to the rubber blade 930.

A part of the wing portions 952 and 953 is accommodated in an extension suction port 50, and the remainder thereof projects to an outside of a housing of the suction nozzle 70. In particular, the other end 952*c* of the wing portion that projects to the outside of the housing of the suction nozzle 70 comes in contact with a cornered surface to be cleaned where walls join together to sweep the surface to be cleaned.

Accordingly, the pollutants existing on the cornered surface to be cleaned move to the front (F) of the suction nozzle 70 or flow into the extension suction port 50.

Wing supports 950 and 951 support upper surfaces of the wing portions 952 and 953. The wing supports 950 and 951 support brushes 952' and 953' so that the brushes more deeply sweep the surface to be cleaned. Further, because the wing supports 950 and 951 vibrate by themselves, the wing portions 952 and 953 may vibrate more quickly and strongly.

The wing supports 950 and 951 and the wing portions 952 and 953 may be slantingly arranged toward the front (F) of the suction nozzle so that they have a constant angle with the vibration bar 906 and the rubber blade 930. Such an arrangement prevents the swept pollutants from being dispersed to the rear (R) of the suction nozzle.

The wing portion 952 may be formed to have a T-shaped cross section. In this case, on an upper portion of the wing portion 952, at least two sliding portions 952*a* and 952*b*, which are horizontal to the surface to be cleaned and which project to the front (F) and the rear (R) of the suction nozzle, are formed.

Further, a brush 952' is formed in a vertical lower portion of the sliding portions 952*a* and 952*b*.

The brush 952' sticks or is fixed to the sliding portions 952*a* and 952*b* so as not to be separated from the sliding portions, and comes in contact with the surface to be cleaned as it vibrates to the front (F) and the rear (R) together with the vibration of the wing portion 952.

Because the brush 952' is formed of soft fine bristles, it can minimize damage that occurs on the surface to be cleaned when sweeping the surface to be cleaned.

Further, the brush 952' according to this embodiment has an excellent adsorption force with respect to pollutants and dust on the surface to be cleaned as compared with the wing blade 852' according to an embodiment of the present disclosure, and thus the cleaning efficiency for the cornered surface to be cleaned is maximized.

The sliding portions 952*a* and 952*b* of the wing portion can be integrally formed with the rubber blade 930. However, it is not limited that the sliding portions 952*a* and 952*b* of the wing portion are separately coupled to the rubber blade 930.

The sliding portions 952*a* and 952*b* according to this embodiment are wider than the sliding portions 750*a* and 750*b* according to an embodiment of the present disclosure, and project further to the front (F) and the rear (R) of the suction nozzle.

This is because a separate groove for coupling the wing portion 952 is not formed on the wing support 950, but an upper flat surface that is formed on the sliding portions 952*a* and 952*b* is configured to stick to a lower surface of the wing support 950. That is, it is not necessary that the width of the sliding portions 952*a* and 952*b* is smaller than the groove (not illustrated) that is formed at the lower end of the vibration bar 906, but the sliding portions may be formed rather wider than the groove (not illustrated).

Accordingly, the sliding portions 952*a* and 952*b* according to this embodiment maximally prevent the dust or pollutants, which are generated when the wing portion 952 vibrates and the brush 952' sweeps the surface to be cleaned, from scattering in the vertical direction of the surface to be cleaned.

If the sliding portions 952*a* and 952*b* of the wing portion are integrally formed with the rubber blade 930, a part of the rubber blade 930 is slidably coupled to the groove (not illustrated) formed at the lower end of the vibration bar, and upper surfaces of the sliding portions 952*a* and 952*b* stick to the lower surface of the extension portion 950 to be mounted thereon.

Accordingly, the rubber blade 930 and the wing portion 952 can be easily mounted onto the groove (not illustrated) formed at the lower end of the vibration bar, and in the case where the rubber blade 930 and the wing portion 952 are worn away, a user can easily replace the rubber blade 930 and the wing portion 952.

A plurality of convex portions 906' and grooves 906" are formed at constant intervals along the length direction of the vibration bar 906 on a surface of the vibration bar 906 that is directed to the rear (R), and the thickness of both ends 906*b* and 906*c* of the vibration bar becomes thinned by the grooves 906". Accordingly, the amplitude in accordance with the resonance can be maximized at the both ends 906*b* and 906*c* of the vibration bar.

Further, if the grooves 906" are formed when the vibration bar 906 is injection-molded, a raw material for manufacturing the vibration bar 906 is reduced, and thus the manufacturing cost of the vibration cleaning unit 900 can be saved.

The vibration bar 906 according to this embodiment is formed so that the center portion 906*a* is closer to the surface to be cleaned than both ends 906*b* and 906*c* of the vibration bar on the basis of the surface to be cleaned. Accordingly, the center portion 906*a* of the vibration bar makes the pollutants having large volume and heavy weight easily go over the rubber blade 930 and the vibration bar 906 to be sucked into the pollutant inflow space 108.

According to the vibration cleaning unit 900 according to this embodiment, the cleaning range for the cornered surface to be cleaned is greatly extended by the wing portions 952 and 953 that vibrate through the resonance phenomenon, and the cleaning efficiency for the cornered surface to be cleaned is heightened.

Further, because the wing supports 950 and 951 support the wing portions 952 and 953 so that the wing portions 952 and 953 can sweep the surface to be cleaned more deeply, the vibration cleaning unit 900 according to this embodiment has very high cleaning efficiency.

Because it is possible that the wing supports 950 and 951 and the wing portions 952 and 953 are made of a material having higher elasticity than that of the vibration bar 906, the vibration cleaning unit 900 according to this embodiment can clean the cornered surface to be cleaned without additional power consumption.

Further, because the brush 952' having high adsorption force for the dust and pollutants is mounted on the wing portion 952, it has higher cleaning efficiency than that of the rubber blade 750'.

Hereinafter, an embodiment in which a vibration cleaning unit and an extension suction port according to various embodiments of the present disclosure are applied to a robot cleaner will be described.

Because the vibration cleaning unit that is applied to the robot cleaner according to this embodiment has been described in detail in various embodiments and has the same configuration, detailed explanation of the vibration cleaning unit will be omitted.

In explaining a robot cleaner 2 according to an embodiment of the present disclosure, a robot cleaner using a rotary brush is exemplified. However, the type of a robot cleaner is not limited thereto, but the robot cleaner can be applied to various kinds of robot cleaners including a cyclone vacuum suction type.

Figure 33:
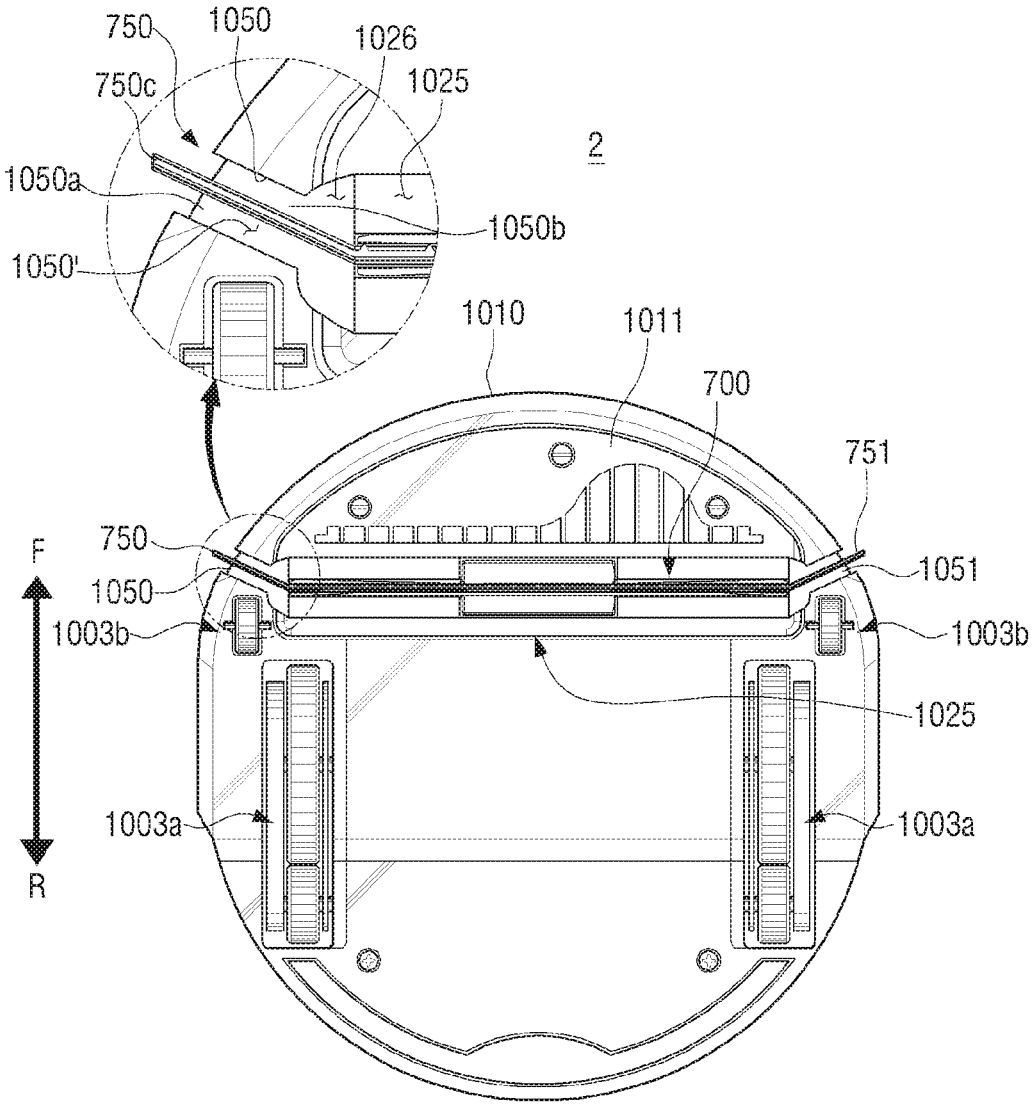
FIG. 33 is a view illustrating a state where a vibration cleaning unit is mounted on a robot cleaner as seen from a bottom according to an embodiment of the present disclosure.
Figure 34:
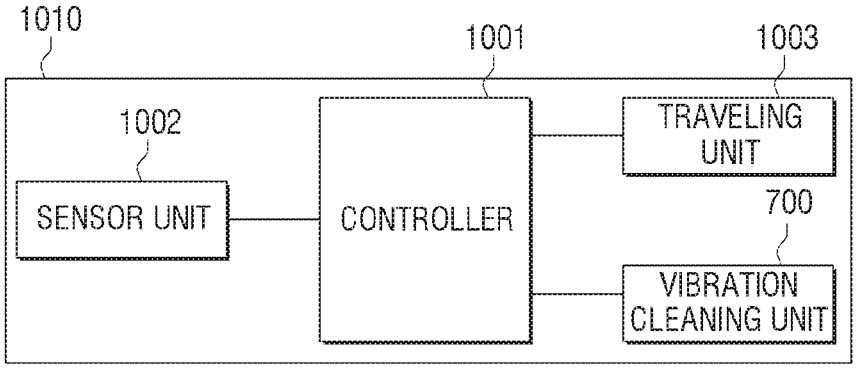
FIG. 34 is a schematic diagram schematically illustrating the configuration of a robot cleaner according to an embodiment of the present disclosure.

FIG. 33 is a bottom view illustrating a robot cleaner mounted with an extension suction port and a vibration cleaning unit according to an embodiment of the present disclosure, and FIG. 34 is a schematic diagram schematically illustrating the configuration of a robot cleaner according to an embodiment of the present disclosure.

A robot cleaner 2 includes a main body 1010, a traveling unit 1003, an obstacle sensing unit 1002, a vibration cleaning unit 100 to 900 according to various embodiments of the present disclosure, and a controller 1001 configured to control the traveling unit and the vibration cleaning unit.

In this embodiment, for convenience in explanation, explanation will be made on the assumption that a vibration cleaning unit 700 according to an embodiment of the present disclosure is applied. However, this is merely exemplary, and application of vibration cleaning units according to other embodiments is not limited.

An external appearance of a robot cleaner 2 is formed by the main body 1010, and the robot cleaner 2 does not include a suction nozzle 20 that is included in a vacuum cleaner.

A suction port 1025 is formed on a bottom surface of the main body 1010, and the vibration cleaning unit 700 is mounted in the suction port 1025.

The suction port 1025 and the obstacle sensing unit 1002 may be formed on a forepart 1011 of the main body. In particular, the obstacle sensing unit 1002 should be mounted on the forepart 1011 of the main body so as to easily detect an obstacle existing in the front (F) in the traveling direction of the robot cleaner 2.

The traveling unit 1003 projects from a bottom surface of the main body 1010. The traveling unit 1003 is composed of driving wheels 1003*a* connected to a separate driver (not illustrated), and direction changing wheels 1003*b* connected to a controller 1001.

The controller 1001 is electrically connected to the obstacle sensing unit 1002, the traveling unit 1003, and the vibration cleaning unit 700. The controller 1001 receives information input from the sensing unit 1002 and a controller (not illustrated), and provides a feedback thereof to the traveling unit 1003 and the vibration cleaning unit 700 to control the traveling direction and cleaning work of the robot cleaner 2.

At both ends of the suction port 1025 formed on a bottom surface of the main body 1010, at least one extension groove 1026 may be formed. Further, on an outside of the extension groove 1026, at least one extension suction port 1050 and 1051 may be additionally formed.

One end 1050*b* of the extension suction port is connected to the outside of the extension groove 1026 to perform fluid communication with the extension groove 1025, and the other end 1050*a* thereof is opened toward the outside of the main body 1010 of the robot cleaner.

Because the extension groove 1026 performs fluid communication with the suction port 1025, the extension suction port 1050 performs fluid communication with the suction port 1025 through the extension groove 1026. Accordingly, pollutants and dust that exist on a surface to be cleaned move to the suction port 1025 through an additional suction flow path 1050' formed on the extension suction port 1050 and the extension groove 1026.

The extension suction port 1050 may be formed to form a predetermined angle with the suction port 1025 and the vibration bar 706. That is, the other end 1050*a* of the extension suction port may be formed to be further inclined toward the front (F) of the suction nozzle than one end 1050*b* thereof.

This is to make the extension suction port 1050 easily approach a cornered surface to be cleaned so as to easily suck the dust and pollutants existing on the cornered surface to be cleaned through the suction port.

One end 1050*b* and the other end 1050*a* of the extension suction port may be connected by a straight line, but are not limited thereto. The ends of the extension suction port may be connected in various shapes.

However, in any case, the other end 1050*a* of the extension suction port may be formed to be further inclined toward the front (F) of the suction nozzle than the one end 1050*b* thereof.

If an extension portion or a wing support is formed on the vibration cleaning unit 700, the extension groove 1026 may accommodate therein the extension portion or the wing support.

Further, the extension suction port 1050 can accommodate therein a wing portion 750 that is formed on the vibration cleaning unit 700. In addition, wing portions 852 and 952 that are included in vibration cleaning units 800 and 900 according to an embodiment of the present disclosure may be accommodated in the extension suction port 1050.

A part of the wing portion 750 is accommodated in the extension suction port 1050, and the remainder projects to the outside of the main body 1010 of the robot cleaner. In particular, the other end 750*c* of the wing portion projects farthest from the extension suction port 1050, and can come in direct contact with the cornered surface to be cleaned.

Accordingly, because the robot cleaner 2 according to this embodiment can sweep the cornered surface to be cleaned by the wing portion 750, it has very wide cleaning range and very high cleaning efficiency for the cornered surface to be cleaned.

Because the vibration cleaning unit that is applied to the robot cleaner 2 according to this embodiment amplifies the vibration frequency using the resonance phenomenon, it can be driven with low power as compared with the robot cleaner in the related art. Accordingly, because low power is consumed to drive the vibration cleaning unit, the operation time of the robot cleaner 2 is further lengthened.

Further, although the robot cleaner 2 according to this embodiment drives the vibration cleaning unit with low power, the vibration cleaning unit vibrates at high speed due to the resonance phenomenon, and thus the cleaning efficiency for the surface to be cleaned is very high as compared with that of the robot cleaner in the related art.

While the present disclosure has been shown and described with reference to embodiments thereof, it will be understood by those skilled in the art that various changes in form and detail may be made therein without departing from the spirit and scope of the present disclosure, as defined by the appended claims.

What is claimed is:

1. A suction nozzle comprising:

a housing including a suction port formed on a bottom surface of the housing, and a suction flow path formed inside the housing and connected to the suction port; and a vibration cleaner arranged on the suction flow path, wherein the vibration cleaner includes:

a vibration source configured to produce a vibration;

a vibration transfer frame configured to accommodate the vibration source and transfer the produced vibration, wherein the vibration source is mounted along the vibration transfer frame;

at least two elastic members respectively arranged at each end of the vibration transfer frame and connecting the vibration cleaner to the housing; and a vibration bar extending in a first longitudinal direction in parallel with a longitudinal axis of the at least two elastic members and configured to receive the vibration transferred from the vibration transfer frame and to resonate based on the received vibration to be flexed toward a front of the housing or a rear of the housing in a second direction perpendicular to the first longitudinal direction.

2. The suction nozzle as claimed in claim 1, wherein the vibration is produced along a plane substantially parallel to the bottom surface.

3. The suction nozzle as claimed in claim 1, wherein a pollutant inflow space is formed between the vibration transfer frame and the vibration bar.

4. The suction nozzle as claimed in claim 1, wherein the vibration transfer frame is connected to the vibration bar by a connection member.

5. The suction nozzle as claimed in claim 1, wherein the vibration bar includes a skirt that is formed along a length of the vibration bar and is configured to contact the surface to be cleaned.

6. The suction nozzle as claimed in claim 1, wherein the vibration bar comprises at least one rubber blade coupled along a lower portion of the vibration bar.

7. The suction nozzle as claimed in claim 6, wherein the vibration bar further comprises at least one extension blade extending from at least one end of the at least one rubber blade, and wherein at least one extension groove configured to accommodate the extension blade is formed on at least one side of the suction port.

8. The suction nozzle as claimed in claim 6, wherein the rubber blade comprises an auxiliary blade projecting further than the rubber blade from the bottom surface.

9. The suction nozzle as claimed in claim 6, further comprising:

at least one extension groove formed on at least one side of the suction port;

at least one extension suction port including a first end connected to the extension groove and second end connected to an opening in a side of the housing; and at least one wing portion extending from the at least one rubber blade, wherein a part of the at least one wing portion is accommodated in the extension suction port, and a remainder of the wing portion projects outside of the housing of the suction nozzle.

10. The suction nozzle as claimed in claim 9, wherein the at least one wing portion is integrally formed with the at least one rubber blade, and configured to contact a surface to be cleaned.

11. The suction nozzle as claimed in claim 1, further comprising:

at least one extension portion formed to extend from at least one end of the vibration bar; and at least one extension groove formed on at least one side of the suction port, wherein the at least one extension portion is integrally formed with the vibration bar, and is accommodated in the at least one extension groove.

12. The suction nozzle as claimed in claim 1, further comprising:

a brush coupled to the vibration bar.

13. The suction nozzle as claimed in claim 1, wherein the at least two elastic members include at least four elastic members.

14. The suction nozzle as claimed in claim 1, further comprising:

at least one extension portion formed in at least one end of the vibration bar;

at least one extension groove formed on at least one side of the suction port to accommodate the extension portion; and at least one extension suction port including a first end connected to the extension groove and second end connected to an opening in a side of the housing.

15. The suction nozzle as claimed in claim 14, further comprising:

at least one wing portion extending from the at least one extension portion, wherein a part of the at least one wing portion is accommodated in the extension suction port, and a remainder thereof projects outside of the housing of the suction nozzle.

16. The suction nozzle as claimed in claim 1, further comprising:

at least one variable portion formed on at least one end of the suction nozzle and configured to open one end of the suction port; and a variable portion elastic member configured to elastically move the at least one variable portion from a first position to a second position.

17. The suction nozzle as claimed in claim 16, further comprising:

at least one hinge formed at at least one end of the suction nozzle, wherein the variable portion elastic member includes a torsion spring arranged around the at least one hinge element, and wherein the at least one variable portion is moved from the first position to the second position on the at least one hinge.

18. The suction nozzle as claimed in claim 16, further comprising:

a sliding member formed between one end of the suction nozzle and the at least one variable portion, wherein the variable portion elastic member includes at least one of a coil spring and a pin spring, and wherein the at least one variable portion is movable from the first position to the second position along the sliding member.

19. A vacuum cleaner comprising:

a main body;

a housing connected to the main body and having a suction port; and a suction nozzle arranged inside the housing and including a vibration cleaner positioned adjacent to the suction port, wherein the vibration cleaner includes:

a vibration source configured to produce a vibration;

a vibration transfer frame configured to accommodate the vibration source and transfer the produced vibration, wherein the vibration source is mounted along the vibration transfer frame;

at least two elastic members respectively arranged at each end of the vibration transfer frame and connecting the vibration cleaner to the housing; and a vibration bar extending in a first longitudinal direction in parallel with a longitudinal axis of the at least two elastic members and configured to receive the vibration transferred from the vibration transfer frame and to resonate based on the received vibration to be flexed toward a front of the housing or a rear of the housing in a second direction perpendicular to the first longitudinal direction.

20. A robot cleaner comprising:

a main body including a bottom surface having a suction port;

at least one wheel installed on the main body;

an obstacle sensor installed on a front portion of the main body and configured to sense an obstacle and generate obstacle information based on the sensed obstacle;

a vibration cleaner arranged in the main body adjacent to the suction port; and a controller configured to control a motion of the at least one wheel based on the generated obstacle information and to control the vibration cleaner, wherein the vibration cleaner includes:

a vibration source configured to produce a vibration;

a vibration transfer frame configured to accommodate the vibration source and transfer the produced vibration, wherein the vibration source is mounted along the vibration transfer frame;

at least two elastic members respectively arranged at each end of the vibration transfer frame and connecting the vibration cleaner to the housing; and a vibration bar extending in a first longitudinal direction in parallel with a longitudinal axis of the at least two elastic members and configured to receive the vibration transferred from the vibration transfer frame and to resonate based on the received vibration to be flexed toward a front of the housing or a rear of the housing in a second direction perpendicular to the first longitudinal direction.

* * * * *